US007350366B2

(12) United States Patent
Yakumaru et al.

(10) Patent No.: US 7,350,366 B2
(45) Date of Patent: Apr. 1, 2008

(54) HEAT PUMP

(75) Inventors: Yuuichi Yakumaru, Osaka (JP); Tomoichiro Tamura, Osaka (JP); Tetsuya Saito, Osaka (JP); Masaya Honma, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 19 days.

(21) Appl. No.: 11/497,959

(22) Filed: Aug. 2, 2006

(65) Prior Publication Data

US 2006/0266057 A1 Nov. 30, 2006

Related U.S. Application Data

(63) Continuation of application No. PCT/JP2005/015706, filed on Aug. 30, 2005.

(30) Foreign Application Priority Data

Sep. 1, 2004 (JP) ..... 2004-254496

(51) Int. Cl.
*F25B 1/00* (2006.01)
*F25B 13/00* (2006.01)
*F25D 9/00* (2006.01)

(52) U.S. Cl. ..... 62/116; 62/160; 62/196.1; 62/222; 62/401; 62/498

(58) Field of Classification Search ..... 62/401, 62/402, 116, 498, 500, 160, 324.1, 196.1, 62/197, 222
See application file for complete search history.

(56) References Cited

U.S. PATENT DOCUMENTS 6,923,016 B2 * 8/2005 Funakoshi et al. ..... 62/324.1
2007/0068178 A1 * 3/2007 Honma et al. ..... 62/160

FOREIGN PATENT DOCUMENTS

JP 2001-66006 3/2001
JP 2003-74999 3/2003
JP 2003-121018 4/2003

* cited by examiner

*Primary Examiner*—Marc Norman
(74) *Attorney, Agent, or Firm*—Hamre, Schumann, Mueller & Larson, P.C.

(57) ABSTRACT

The present invention provides a heat pump including: a compressor; a radiator; a first throttling device having a variable opening; an expander; a second throttling device having a variable opening; an evaporator; piping that connects the compressor, the radiator, the first throttling device, the expander, the second throttling device, and the evaporator so that refrigerant circulates thorough the elements in that order; and a control device for controlling the opening of the first throttling device and the opening of the second throttling device. This heat pump is capable of independently controlling the pressure of the refrigerant flowing into the expander (intermediate pressure) and pressure in a high-pressure side of a refrigeration cycle, and also is capable of size reduction, or in some cases elimination, of a receiver for the refrigerant.

14 Claims, 21 Drawing Sheets

HEAT PUMP

This application is a continuation of prior pending International Application Number PCT/JP2005/015706, filed on Aug. 30, 2005, which designated the United States.

BACKGROUND OF THE INVENTION

1. Field of the Invention

The present invention relates to heat pumps useful for hot water heaters, air-conditioners, and the like, and more particularly to a heat pump furnished with a mechanism for recovering energy by an expander.

2. Description of the Related Art

A heat pump employing an expander in place of an expansion valve can recover the expansion energy of refrigerant as electric power or mechanical power. As the expander, in many cases a positive displacement expander is used that has a space with a variable capacity for introducing and expanding refrigerant therein. The energy recovery with the expander has a significant value, particularly in the transcritical cycle of carbon dioxide in which the high-pressure side reaches a supercritical state of the refrigerant.

Because of its structure, the expander cannot recover energy unless the refrigerant passes through it in a predetermined direction. In a heat pump used for an air-conditioner, however, it is basically required that the refrigerant should flow in opposite directions when in a cooling operation and when in a heating operation because it is necessary to use a heat exchanger installed indoors as a radiator during the heating operation but as an evaporator during the cooling operation.

JP 2001-66006A discloses a heat pump capable of energy recovery with an expander in both cooling and heating operations. This heat pump is designed so that the refrigerant can flow through the expander in the same direction in both operations of cooling and heating by switching a four-way valve. Furthermore, in this heat pump, the expander and a compressor are connected to the same rotating shaft. In other words, they are directly coupled, in order to use the energy recovered by the expander directly for operating the compressor.

In the heat pump in which the expander and the compressor are directly coupled, the expander and the compressor operate at the same rotational speed and therefore it is impossible to vary the ratio between the displacement of the expander and the displacement of the compressor according to the operation condition. For that reason, the heat pump of this type has difficulty in performing a smooth operation according to the operation condition, although it has good efficiency in energy recovery. JP 2003-121018A discloses a heat pump that decreases this difficulty.

As illustrated in FIG. 20, JP 2003-121018A discloses a heat pump in which two four-way valves 131 and 134 are disposed in pipes 110 so that the refrigerant can flow in the same direction through an expander 104 and a compressor 101 in both operations of cooling and heating by switching the four-way valves 131 and 134, as in JP 2001-66006A. In an air-conditioner employing this heat pump, the passages shown by solid lines in the four-way valves 131 and 134 are selected during heating so that an indoor heat exchanger 132 functions as a radiator and an outdoor heat exchanger 136 functions as an evaporator. In this air-conditioner, the passages shown by broken lines in the four-way valves 131 and 134 are selected during cooling so that the indoor heat exchanger 132 functions as an evaporator and the outdoor heat exchanger 136 functions as a radiator. In this heat pump, the expander 104 and the compressor 101 are coupled directly to share a single rotating shaft, and this rotating shaft is driven by a motor 130.

In the heat pump disclosed in JP 2003-121018A, an expansion valve (bypass valve) 139 is disposed in a bypass circuit 120 disposed in parallel with the expander 104, and an expansion valve 105 is disposed in series with the expander 104. The opening of the expansion valve 105 or the expansion valve 139 is controlled according to the operation condition.

As discussed above, although the heat pump in which the expander and the compressor are directly coupled is advantageous in energy recovery, it cannot change the displacement ratio between the expander and the compressor according to an operation condition. For example, if the expander is designed based on a standard condition in a cooling operation, the displacement of the expander will be too large in a heating operation with respect to the required value. For that reason, in the heat pump disclosed in JP 2003-121018A, the bypass valve 139 is fully closed during a heating operation, and the opening of the expansion valve 105 is controlled as appropriate. If the opening of the expansion valve 105 is reduced, the specific volume of the refrigerant flowing into the expander 104 will increase. In a cooling operation, the displacement of the expander 104 may become less than the required value. When this is the case, the expansion valve 105 is fully opened, and the opening of the bypass valve 139 is controlled as appropriate. Thus, the heat pump disclosed in JP 2003-121018A is capable of smooth cycle operations according to operation conditions.

FIG. 21 is a Mollier diagram illustrating the refrigeration cycle of the heat pump shown in FIG. 20. The refrigerant that is discharged from the compressor 101 and that is in the state a at a high pressure $P_H$ radiates heat at the indoor heat exchanger 132 or the outdoor heat exchanger 136 that functions as the radiator 104, and then reaches state b. The refrigerant undergoes isentropic expansion in the expander 104, reaching state c at an intermediate pressure $P_M$, and then further undergoes isenthalpic expansion at the expansion valve 105, reaching a state d at a low pressure $P_L$. The refrigerant then absorbs heat at the outdoor heat exchanger 136 or the indoor heat exchanger 132 that functions as the evaporator, reaching state e, and thereafter flows into the compressor 101. In this heat pump, the energy corresponding to an enthalpy difference $W_2$ between state b and state d is recovered by the expander 104. Therefore, it is sufficient that, basically, the mechanical power corresponding to a value ($W_1$-$W_2$), obtained by subtracting the enthalpy difference $W_2$ from a enthalpy difference $W_1$ between state a and state e, is input to this heat pump.

JP 2003-121018A also discloses a heat pump in which, as illustrated in FIG. 22, the expansion valve 105 is disposed on the upstream side of the expander 104. This heat pump has the same configuration as that of the heat pump shown in FIG. 20 except for the positions of the expansion valve 105 and a receiver 100 for the refrigerant. FIG. 23 shows a Mollier diagram illustrating the refrigeration cycle in the heat pump shown in FIG. 22. This refrigeration cycle is the same as the refrigeration cycle shown in FIG. 21 except that the isenthalpic expansion in the expansion valve 105 (the expansion from state b to state c in FIG. 22) is performed prior to the isentropic expansion in the expander 104 (the expansion from state c to state d in FIG. 23).

In the heat pump disclosed in JP 2003-121018A, the specific volume of the refrigerant flowing into the expander 104, in other words, the pressure of the refrigerant flowing into the expander 104, is controlled by adjusting the opening of the expansion valve 105 disposed on the upstream side or downstream side of the expander 104.

However, when the opening of the expansion valve 105 is controlled in order to control the pressure $P_M$ of the refrigerant flowing into the expander 104, the refrigeration cycle as a whole will shift toward the high-pressure side or the low-pressure side, and as a result, the pressure $P_H$ of the high-pressure side of the refrigeration cycle changes. Even if the pressure $P_M$ can be controlled in the refrigeration cycle, it will be difficult to keep the efficiency of the heat pump high as long as that controlling is accompanied by an unintended change in the pressure $P_H$ of the high-pressure side.

Thus, the control mechanism of the heat pump disclosed in JP 2003-121018A has a problem that the pressure $P_M$ of the refrigerant flowing into the expander 104 and the pressure $P_H$ of the high-pressure side of the refrigeration cycle cannot be controlled independently. One of the reasons is that one of the expansion valves 105 and 139 is fully opened or fully closed and only the other one is controlled; also, an additional factor that makes it difficult to resolve the problem is that, in the heat pump, the two expansion valves are not disposed in a manner that makes it easy to control both the pressure $P_M$ and the pressure $P_H$.

As illustrated in FIGS. 20 and 22, the receiver 100 is in many cases installed in a heat pump that is operated under conditions that require considerably different amounts of refrigerant, such as in a cooling operation and in a heating operation, in order to adjust the amount of refrigerant that circulates in the heat pump. The receiver 100 prevents refrigerant from flowing into the expander 104 in an excessive amount by temporarily reserving the refrigerant.

However, when the reliability of the apparatus is ensured by the receiver, the size of the heat pump increases, and the amount of refrigerant to be charged therein becomes large. The size increase of the heat pump limits the installation position and does not meet the demands of the user. Reducing the amount of refrigerant to be charged has also been a social demand from the viewpoint of reducing environmental load.

The two problems discussed above—the first problem that the pressure $P_M$ of the refrigerant flowing into the expander and the pressure $P_H$ of the refrigerant in the high-pressure side of the refrigeration cycle cannot be controlled independently, and the second problem that the reliability of the apparatus needs to be ensured by the receiver—become evident in the heat pump in which the expander and the compressor are directly coupled, as illustrated in FIGS. 20 and 22, but these problems also exist in the heat pump in which the expander and the compressor are not directly coupled.

For example, by connecting the expander to a power generator, it is possible to construct a heat pump that can recover the energy originating from the expansion of refrigerant as electric power, and in this case, it is not necessary to couple the expander and the compressor directly. Nevertheless, with the heat pump of this type as well, it is desirable to control both the pressure $P_M$ of the refrigerant flowing into the expander and the pressure $P_H$ of the refrigerant in the high-pressure side of the refrigeration cycle to be desired values, in order to achieve a smooth cycle operation according to operation conditions. Moreover, in the heat pump of this type as well, a receiver is usually installed in order to prevent refrigerant from flowing into the expander 104 in an excessive amount.

SUMMARY OF THE INVENTION

In view of the foregoing circumstances, it is an object of the present invention to provide a heat pump that has an expander and independently can control the pressure of the refrigerant flowing into the expander and the pressure of the refrigerant in the high-pressure side of the refrigeration cycle. It is another object of the present invention to provide a heat pump that enables the size of the receiver for refrigerant furnished on the upstream side or the downstream side of an expander to be smaller than was conventionally required, or in a more preferable embodiment, that does not require the receiver.

The present invention provides a heat pump including: a compressor; a radiator; a first throttling device having a variable opening; an expander; a second throttling device having a variable opening; an evaporator; piping that connects the compressor, the radiator, the first throttling device, the expander, the second throttling device, and the evaporator so that refrigerant circulates through the elements in that order; and a control device for controlling the opening of the first throttling device and the opening of the second throttling device.

In the heat pump of the present invention, the first throttling device and the second throttling device having variable openings are disposed on the upstream side and the downstream side of the expander, and the openings of these throttling devices are controlled by a control device. This makes it possible to control independently the pressure (intermediate pressure) $P_M$ (hereinafter designated as $P_I$) of the refrigerant flowing into the expander and the pressure $P_H$ in the high-pressure side of the refrigeration cycle, and as a result, it becomes possible to keep the efficiency of the heat pump high through optimization of the refrigeration cycle according to operation conditions.

In addition, in the heat pump of the present invention, the openings of the first throttling device and the second throttling device are controlled, and therefore, the amount of the refrigerant held in the expander can be adjusted in a wider range than was conventionally possible while maintaining the refrigeration cycle required by an operation condition. The amount of the refrigerant held in the expander can be adjusted in a wide range, and thus the capacity of the receiver for adjusting the amount of the refrigerant that circulates in the heat pump may be smaller, or in some cases, it is possible to provide a heat pump that is not provided with a receiver but is operable under the conditions in which the amounts of refrigerant required are greatly different.

DESCRIPTION OF THE PREFERRED EMBODIMENTS

Figure 1:
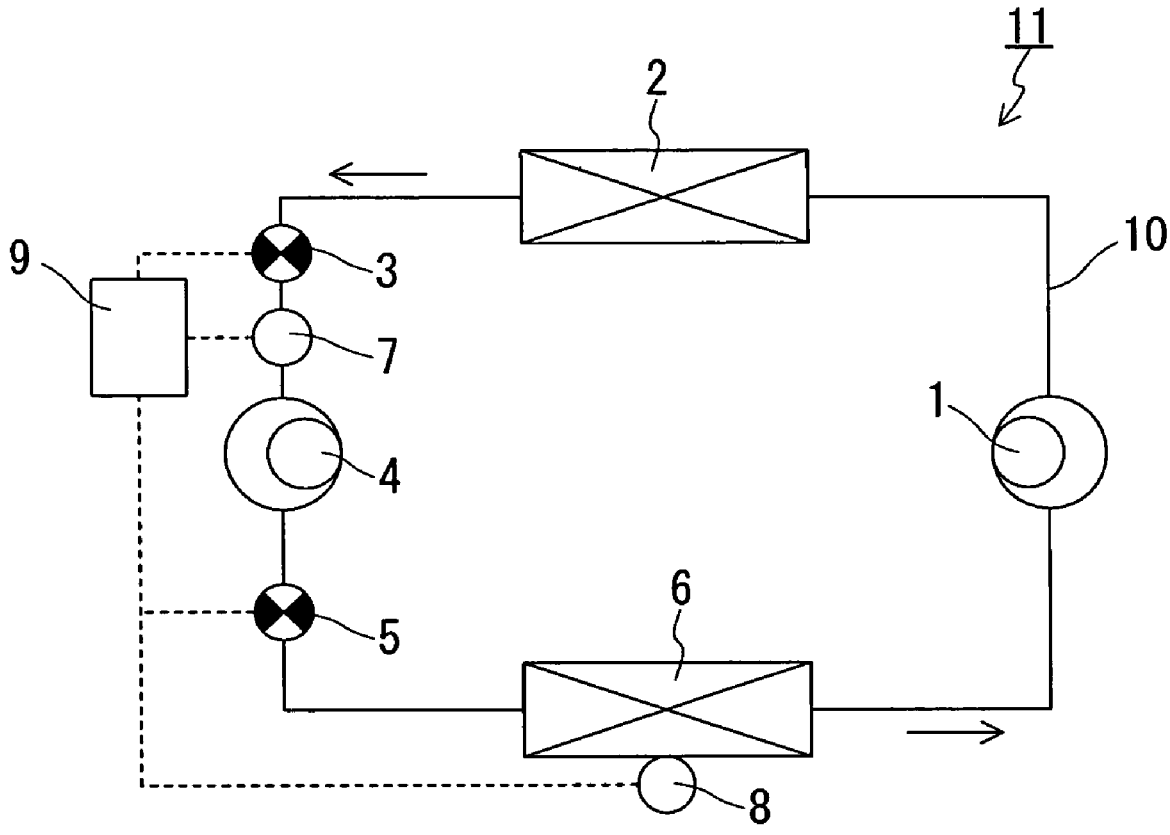
FIG. 1 illustrates one example of the configuration of a heat pump according to the present invention.

Hereinbelow, preferred embodiments of the present invention are described with reference to the drawings. In the following description, the same components and steps may be designated with the same reference numerals to avoid repetitive description.

FIG. 1 illustrates a configuration of one embodiment of the heat pump according to the present invention. This heat pump 11 is provided with a compressor 1, a radiator 2, an expander 4, and an evaporator 6 as the primary constituent components for exhibiting the fundamental functions of a heat pump, and further is provided with piping 10 for connecting the primary constituent components so that refrigerant can circulate therethrough. A suitable displacement of the expander 4 is 5% to 20% of the displacement of the compressor 1. The compressor 1, the radiator 2, the expander 4, and the evaporator 6 are connected by the piping 10 to form a refrigerant circuit. The refrigerant circulates in the refrigerant circuit in the direction indicated by the arrows in FIG. 1, and at the radiator 2, it radiates heat absorbed at the evaporator 6.

In the heat pump 11, a first expansion valve 3, which is a first throttling device, is disposed between the radiator 2 and the expander 4, and a second expansion valve 5, which is a second throttling device, is disposed between the expander 4 and the evaporator 6. Also disposed in the heat pump 11 are a pressure sensor 7 for measuring the pressure of the refrigerant between the expander 4 and the expansion valve 3 (the pressure $P_I$ of the refrigerant flowing into the expander 4) and a temperature sensor 8 for measuring the atmosphere temperature of the evaporator 6.

The openings of the expansion valves 3 and 5 are controlled by a controller (control device) 9. The pressure sensor 7 and the temperature sensor 8, as well as the expansion valves 3 and 5, are connected to the controller 9. The controller 9 adjusts openings of the expansion valves 3 and 5 based on a pressure $P_I$ of the refrigerant that has been measured by the pressure sensor 7 and a temperature of the refrigerant that has been measured by the temperature sensor 8.

Although not shown in FIG. 1, the heat pump 11 further is provided with a power generator connected to the expander 4, and an electric circuit for supplying electric energy obtained by the power generator to the compressor, so that the energy originating from expansion of the refrigerant is recovered at the expander 4 by the power generator and the electric circuit and input to the compressor 1. The energy recovery mechanism made of the power generator and the electric circuit may be a known structure, and according to a publicly known structure, the power generator is disposed, for example, so as to share a rotating shaft with the expander 4.

Figure 2:
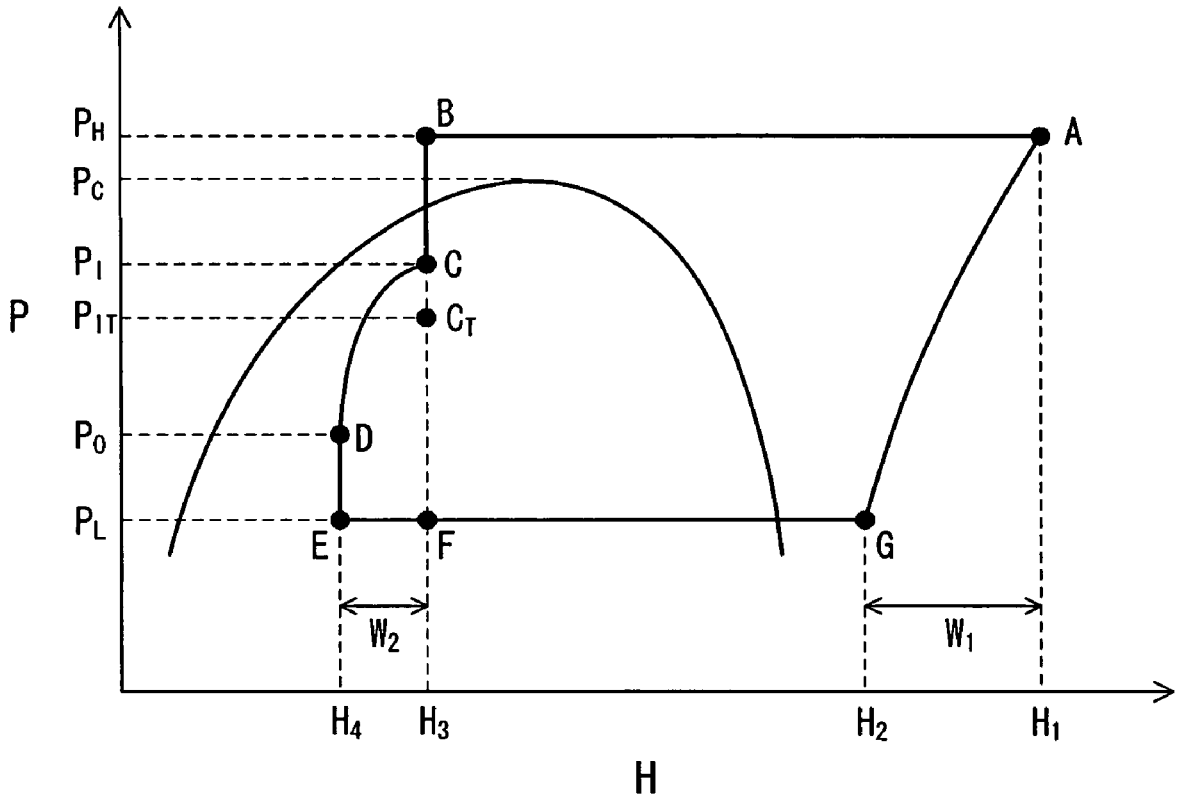
FIG. 2 is a Mollier diagram illustrating a refrigeration cycle of the heat pump shown in FIG. 1.

With reference to FIG. 2, changes in the state of the refrigerant that circulates in the heat pump 11 will be explained. The refrigerant that has been discharged from the compressor 1 and that is in state A at a high pressure $P_H$ radiates heat in the radiator 2, reaching state B. The refrigerant in state B expands while running through the first expansion valve 3, the expander 4, and the second expansion valve 5 in that order, and reaches state E at a low pressure $P_L$.

In this expansion process, the refrigerant first undergoes isenthalpic expansion at the first expansion valve 3, reaching state C at a pressure (intermediate pressure) $P_I$. The refrigerant introduced into the expander 4 at the pressure $P_I$ undergoes isentropic expansion while lowering its own temperature in the expander 4, and reaches state D at a pressure $P_O$; then it is discharged from the expander 4. The refrigerant at the pressure $P_O$ undergoes isenthalpic expansion at the second expansion valve 5, reaching state E at a pressure $P_L$.

After the expansion process, the refrigerant absorbs heat in the evaporator 6, reaching state G. It is then introduced into the compressor 1 and compressed therein, again reaching state A at the high pressure $P_H$, and is discharged therefrom.

Figure 21:
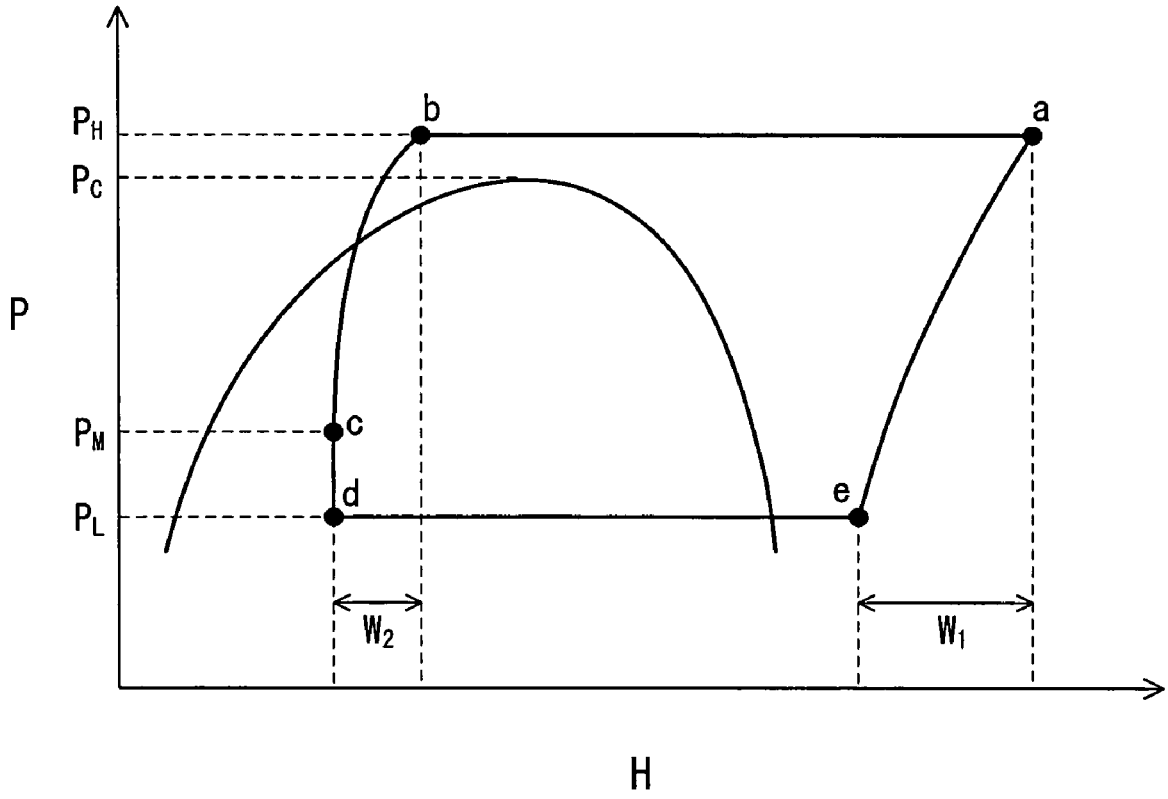
FIG. 21 PRIOR ART
FIG. 21 is a Mollier diagram illustrating the refrigeration cycle of the heat pump shown in FIG. 20.

As discussed previously with reference to FIG. 21, the electric power that can be recovered by the expander 4 likewise can be expressed as an enthalpy difference $W_2$ between point C (point F) and point D in FIG. 2. The minimum value of the mechanical power to be input to the compressor 1 is a value ($W_1-W_2$) obtained by subtracting the enthalpy difference $W_2$ from an enthalpy difference $W_1$ between point A and point G.

FIG. 2 illustrates a refrigeration cycle in which the pressure $P_H$ in the high-pressure side exceeds the critical pressure $P_C$ of carbon dioxide, which is the refrigerant, as an example. As previously discussed, the mechanical power recovery by the expander 4 is very effective in the case of using carbon dioxide as the refrigerant and circulating the refrigerant so that the pressure $P_H$ in the high-pressure side of the refrigeration cycle, in other words, the pressure of the refrigerant discharged from the compressor 1, exceeds the critical pressure $P_C$ of carbon dioxide. It should be noted, however, that the present invention is also applicable to a heat pump that uses other refrigerants such as those represented by alternative refrigerants to chlorofluorocarbons.

Figure 3:
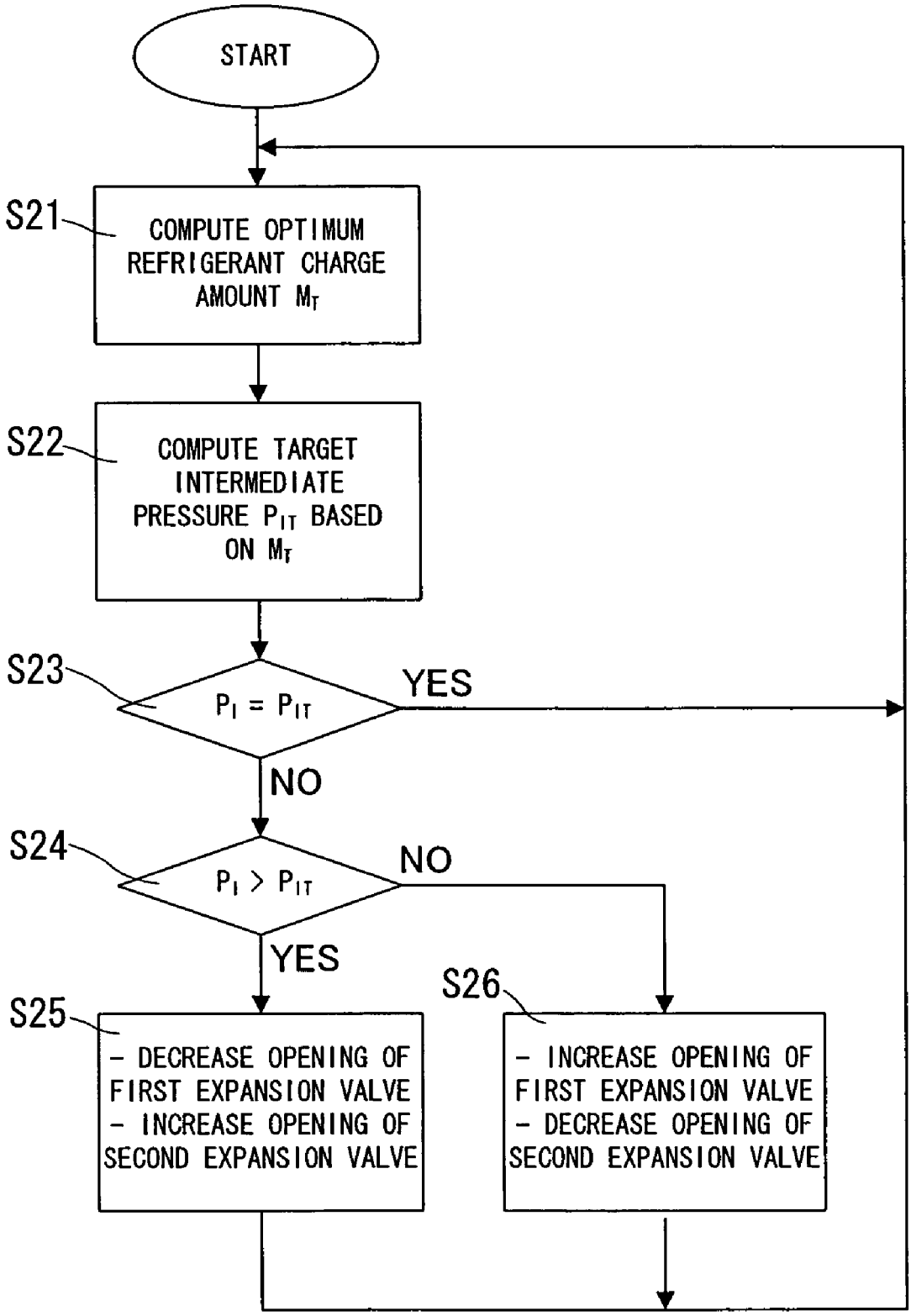
FIG. 3 is a flowchart illustrating one example of controlling the opening of an expansion valve by a control device.

FIG. 3 illustrates, as an example, a control method for the first expansion valve 3 and the second expansion valve 5 with the controller 9. In this example of controlling, while the pressure $P_H$ in the high-pressure side of the refrigeration cycle is being kept at a desirable predetermined value, the pressure $P_I$ of the refrigerant flowing into the expander is controlled to be a desirable predetermined value that is determined according to an operation condition.

First, the controller 9 calculates an optimum amount of the refrigerant that circulates in the heat pump (optimum refrigerant charge amount $M_T$) (step 21: S21).

Figure 4:
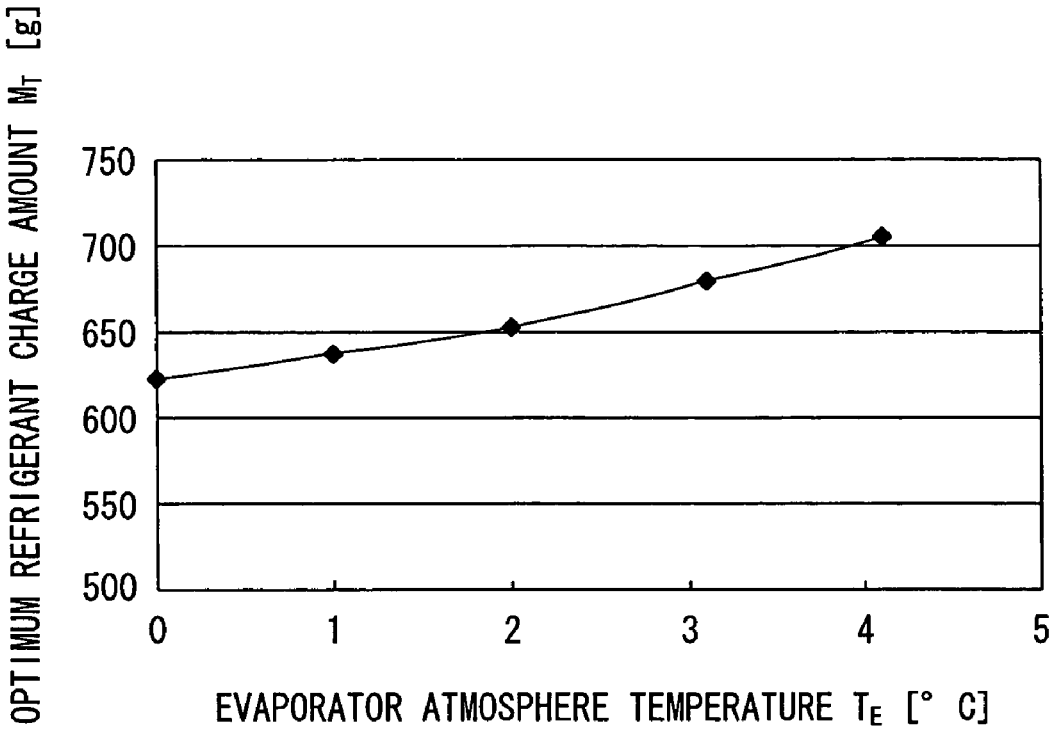
FIG. 4 is a graph illustrating one example of the relationship between evaporator atmosphere temperature $T_E$ and optimum refrigerant charge amount $M_T$.

The optimum amount of the refrigerant that circulates in the heat pump varies according to operation conditions; as the difference between the actual amount of refrigerant circulating and the optimum amount becomes greater, the efficiency of the heat pump lowers. The optimum amount of refrigerant can be calculated, for example, based on the temperature measured by the temperature sensor 8 installed in the evaporator 6, from a relational expression that has been determined in advance in accordance with known techniques. FIG. 4 illustrates one example of the relationship between the air temperature that surrounds the evaporator (evaporator atmosphere temperature $T_E$) and optimum refrigerant circulation amount $M_T$. As illustrated in FIG. 4, the optimum refrigerant circulation amount $M_T$ usually increases as the evaporator atmosphere temperature $T_E$ increases. It is not necessary to determine the optimum refrigerant circulation amount $M_T$ based on the evaporator atmosphere temperature $T_E$, and it may be calculated based on other indicators, such as represented by an atmosphere temperature in the radiator 2.

Next, the controller 9 calculates a target value (target intermediate pressure) $P_{IT}$ of the pressure $P_1$ of the refrigerant flowing into the expander 4 (intermediate pressure) based on the optimum refrigerant charge amount $M_T$ determined at step 21 (step 22: S22).

Figure 5:
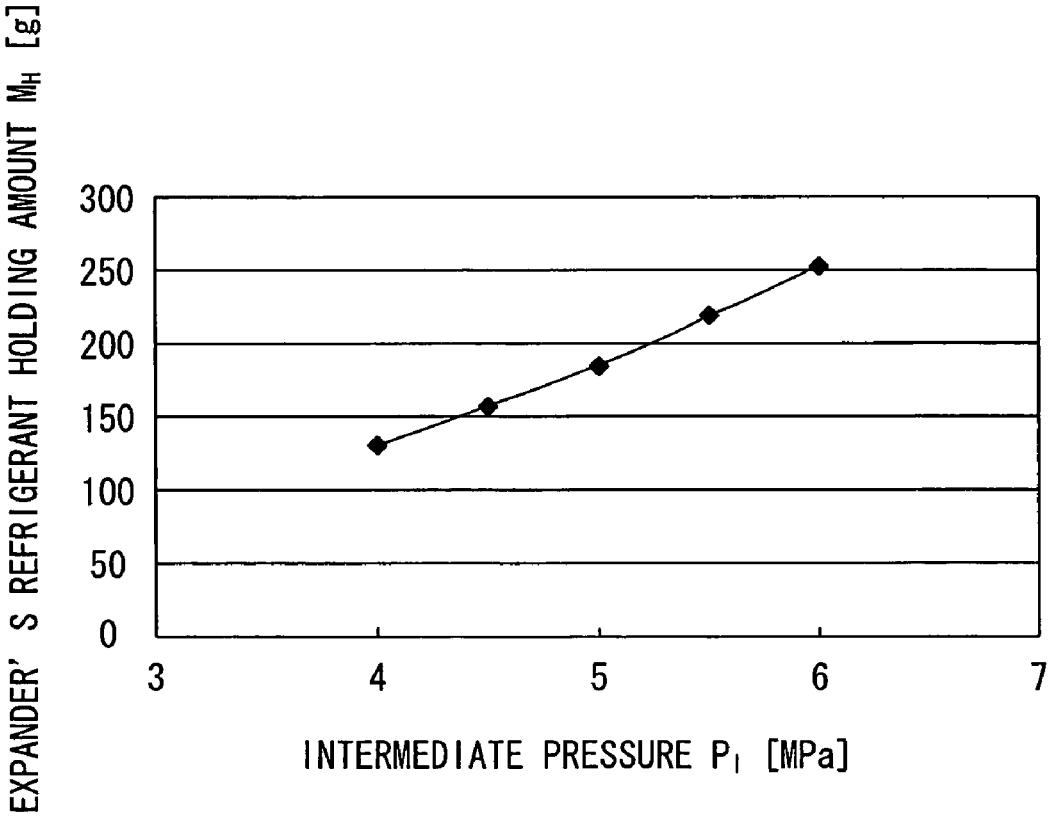
FIG. 5 is a graph illustrating one example of the relationship between intermediate pressure $P_I$ and expander's refrigerant holding amount $M_H$.

The amount of the refrigerant held in the expander 4 (expander's refrigerant holding amount $M_H$) changes according to the pressure $P_I$ of the refrigerant flowing into the expander 4 (intermediate pressure). FIG. 5 illustrates a relationship between intermediate pressure $P_I$ and expander's refrigerant holding amount $M_H$. As illustrated in FIG. 5, the expander's refrigerant holding amount $M_H$ increases according to the increase of the intermediate pressure $P_I$. If the expander's refrigerant holding amount $M_H$ changes, the apparent amount of the refrigerant charged into the heat pump changes. Therefore, by adjusting the holding amount $M_H$ using the intermediate pressure $P_I$ of the refrigerant, the optimum refrigerant charge amount $M_T$ can be controlled.

Figure 6:
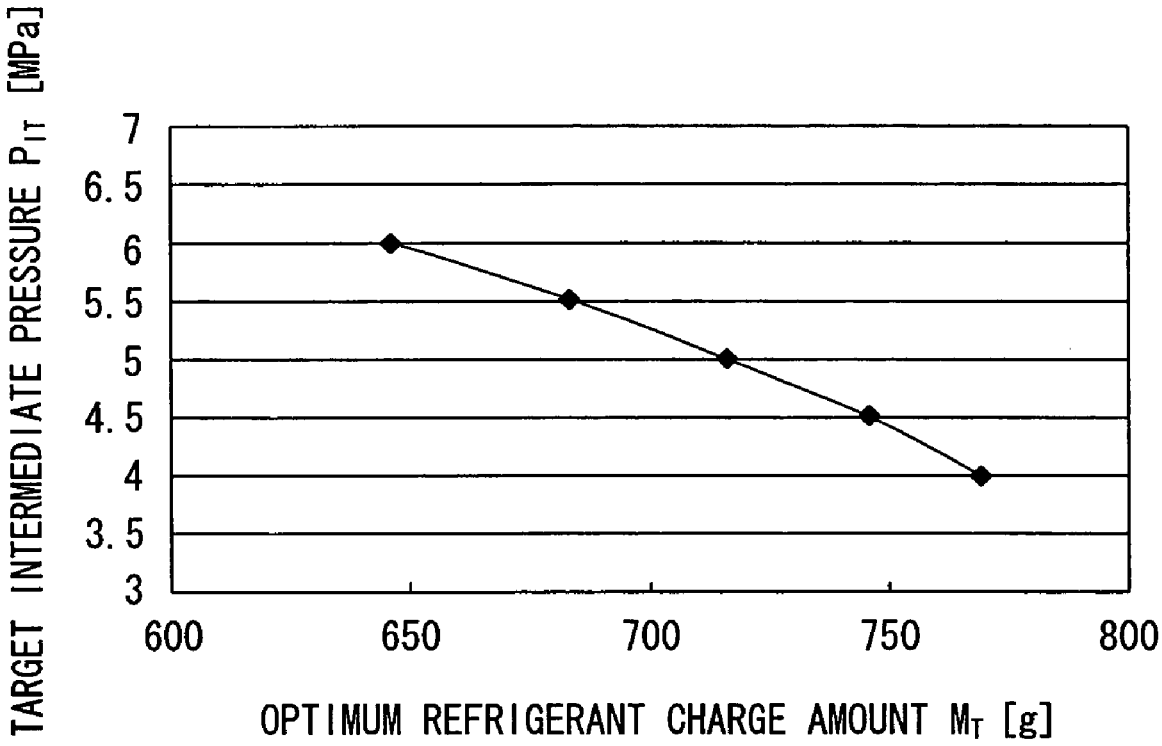
FIG. 6 is a graph illustrating one example of the relationship between optimum refrigerant charge amount $M_T$ and target intermediate pressure $P_{IT}$.

FIG. 6 illustrates, as an example, a relationship between the optimum refrigerant circulation amount $M_T$ and the target intermediate pressure $P_{IT}$, which is to be the target for the control in order to achieve the optimum amount $M_T$. When referring to FIG. 6, it will be understood that the apparent refrigerant charge amount M can be controlled within the range of about 100 g if the intermediate pressure $P_I$ is adjusted appropriately within the range of about 2 MPa. This is a sufficient tolerance to eliminate a receiver from a practical heat pump.

It should be noted that FIGS. 4 to 6 show the data in the cases of using carbon dioxide as the refrigerant.

Figure 20:
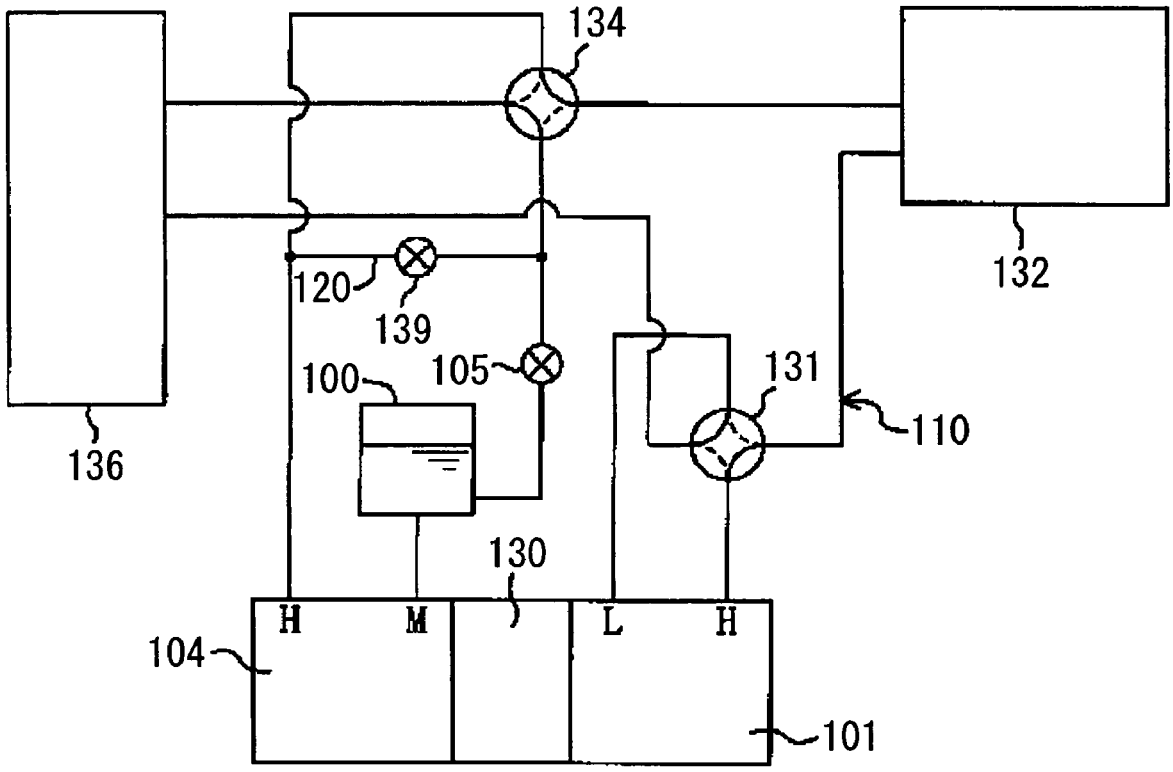
FIG. 20 PRIOR ART
FIG. 20 illustrates one example of the configuration of a conventional heat pump.
Figure 22:
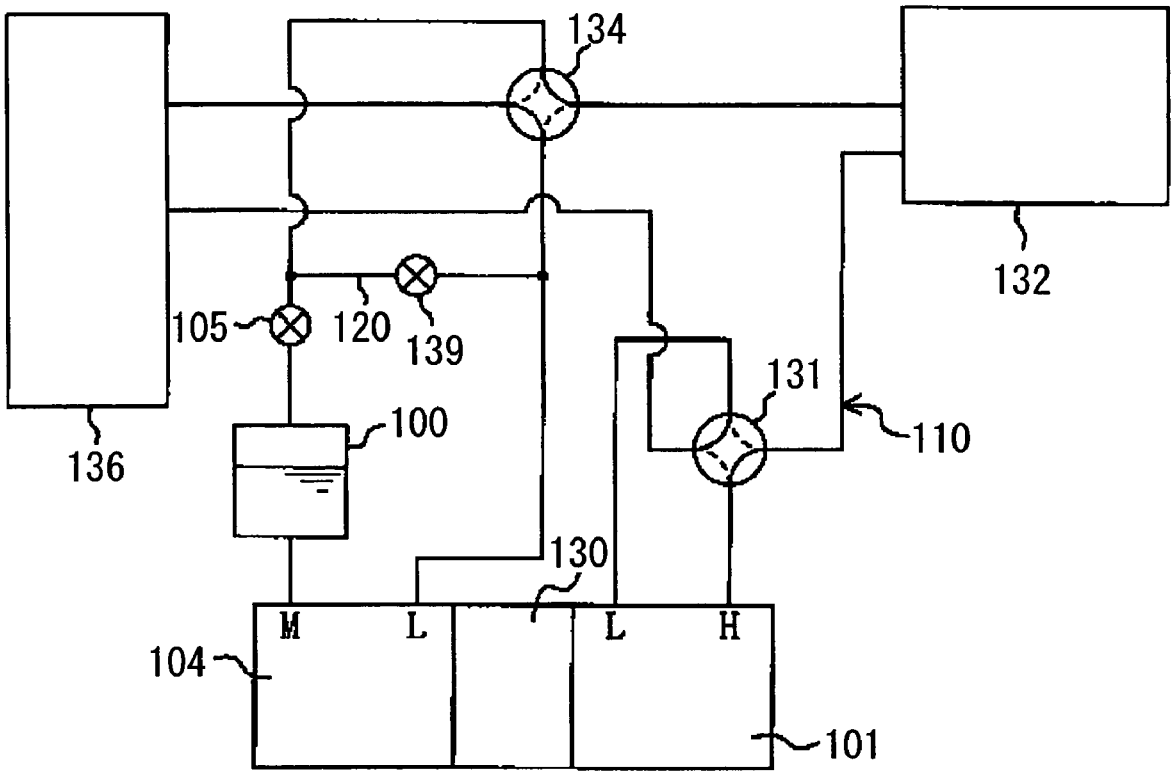
FIG. 22 PRIOR ART
FIG. 22 illustrates another example of the configuration of the conventional heat pump.
Figure 23:
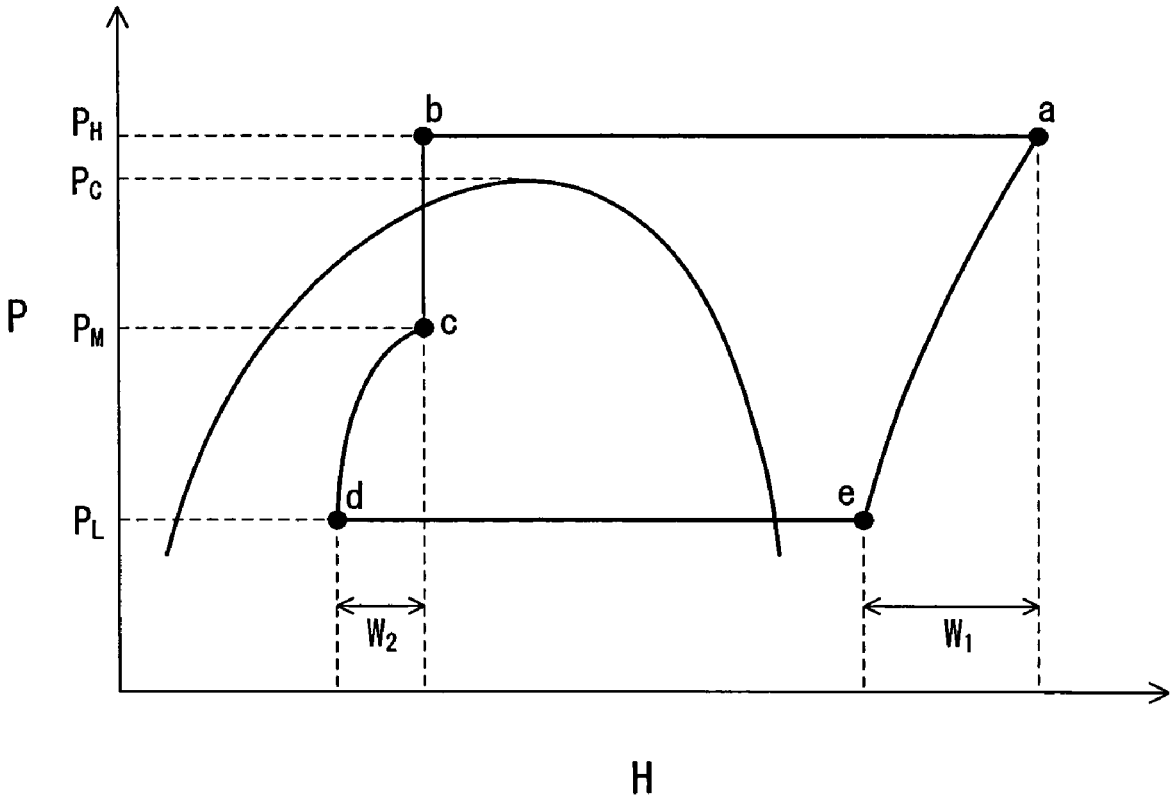
FIG. 23 PRIOR ART
FIG. 23 is a Mollier diagram illustrating the refrigeration cycle of the heat pump shown in FIG. 22.

As illustrated in FIGS. 20 and 22, controlling of the intermediate pressure $P_M$ ($P_I$) itself has been possible even with a conventional beat pump. However, in reality, the intermediate pressure $P_I$ cannot be controlled over a wide range since the pressure $P_H$ of the refrigerant in the high-pressure side of the refrigeration cycle should be kept in a predetermined range required by the operation condition. On the other hand, in the heat pump 11, the openings of the two expansion valves 3 and 5 having variable openings are controlled, whereby the intermediate pressure $P_I$ is controlled over a wide range and the potential refrigerant amount-adjusting function of the expander 4. When using the heat pump 11, the intermediate pressure $P_I$ can be appropriately controlled within the range of 2 MPa while, for example, the pressure $P_H$ in the high-pressure side is being kept at a predetermined value.

Subsequently, the controller 9 compares the actual pressure $P_I$ of the intermediate pressure and the target intermediate pressure $P_{IT}$ (step 23: S23). As a result, if the actual pressure $P_I$ and the target intermediate pressure $P_{IT}$ match ($P_I = P_{IT}$), the process returns to step 21, while if they do not match, the process moves to the next step.

The heat pump illustrated in FIG. 1 can measure directly the actual pressure $P_I$ of the intermediate pressure with the pressure sensor 7. It should be noted that the actual pressure $P_I$ of the intermediate pressure may be a calculated value and, specifically, it may be a value calculated from a predetermined relational expression based on a pressure and/or temperature of the refrigerant that is measured at a different portion of the heat pump.

At the next step, the magnitude relationship between the actual pressure $P_I$ of the intermediate pressure and the target intermediate pressure $P_{IT}$ of the intermediate pressure is determined. In other words, which of the actual pressure $P_I$ and the target intermediate pressure $P_{IT}$ is the greater is determined (step 24: S24).

If the actual pressure $P_I$ is greater than the target intermediate pressure $P_{IT}$, control (a) is executed, in which the opening of the first expansion valve 3 is decreased and the opening of the second expansion valve 5 is increased (step 25: S25). Conversely, if the target intermediate pressure $P_{IT}$ is greater than the actual pressure $P_I$, control (b) is executed, in which the opening of the first expansion valve 3 is increased and the opening of the second expansion valve 5 is decreased (step 26: S26). After executing step 25 or step 26, the process returns to step 21.

In the above-described example of controlling, if the opening of one of the two expansion valves 3 and 5 is increased, the controller 9 closes the other one. Such a controlling makes it easy to keep the pressure $P_H$ of the refrigerant in the high-pressure side of the refrigeration cycle to be a predetermined value. It is preferable that, as described above, the controller 9 execute the control (a), in which the opening of the first expansion valve 3 is decreased and the opening of the second expansion valve 5 is increased, and the control (b), in which the opening of the first expansion valve 3 is increased and the opening of the second expansion valve 5 is decreased. Although it is preferable that the control (a) and the control (b) be executed in such a manner that the pressure of the refrigerant discharged from the compressor, in other words, the pressure $P_H$ in the high-pressure side of the refrigeration cycle, becomes constant, a change in the pressure $P_H$ in the high-pressure side may be permitted within a range in which the operation of the heat cycle works unhindered.

In the above-described example of controlling, the controller 9 changes both openings of the two expansion valves 3 and 5 based on the target intermediate pressure $P_{IT}$ and the actual intermediate pressure $P_I$. It is preferable that the controller 9 thus executes controlling in such a manner that the openings of the two expansion valves 3 and 5 both change so that the actual value becomes closer to the target value of a predetermined characteristic.

Figure 7:
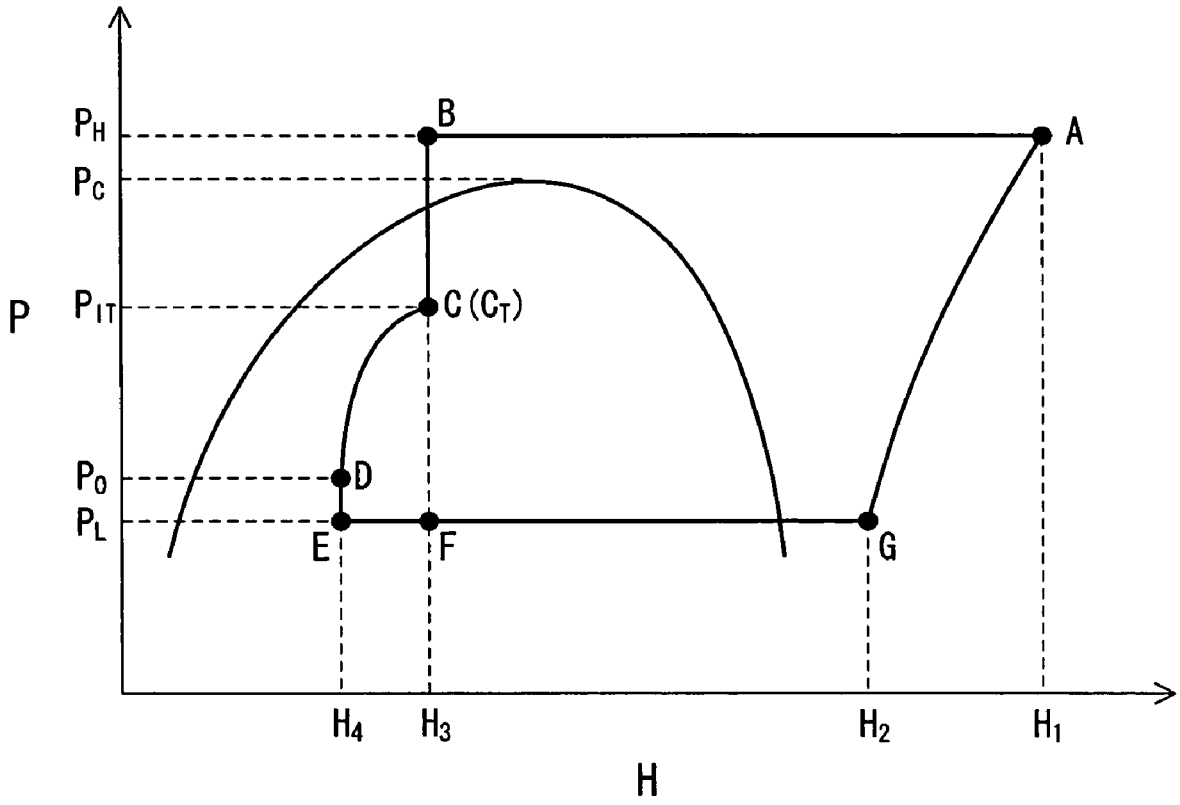
FIG. 7 is a Mollier diagram illustrating one example of the change in a refrigeration cycle by the control process shown in FIG. 3.

FIG. 7 is a Mollier diagram illustrating, as an example, the refrigeration cycle achieved as the result of controlling the refrigeration cycle shown in FIG. 2 based on the example of controlling shown in FIG. 3. In the refrigeration cycle shown in FIG. 2, the intermediate pressure $P_I$ was at a higher state than the target intermediate pressure $P_{IT}$ ($P_I$>$P_{IT}$). In FIG. 7, as the result of executing the control (a), point C in the Mollier diagram is lowered to point $C_T$, and the intermediate pressure $P_I$ and the target intermediate pressure $P_{IT}$ match. Because the opening of the second expansion valve 5 is increased in the control (a), point D also is lowered. In FIG. 7, while the refrigeration cycle in the Mollier diagram as a whole is prevented from shifting, in other words, while the points other than point C and point D are prevented from shifting, the intermediate pressure $P_I$ is guided to an ideal pressure $P_{IT}$.

Figure 8:
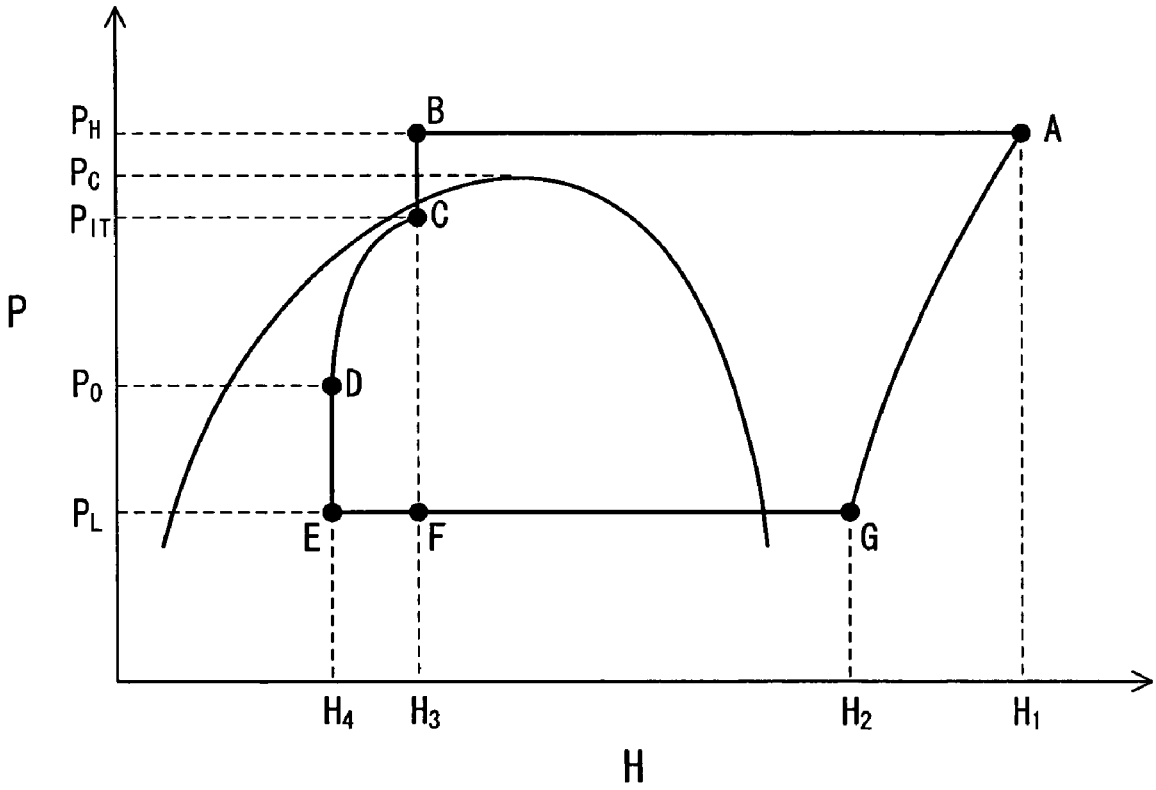
FIG. 8 is a Mollier diagram illustrating another example of the change in a refrigeration cycle by the control process shown in FIG. 3.

FIG. 8 is a Mollier diagram illustrating the refrigeration cycle achieved as the result of the control (b). In the control to attain FIG. 8 as well, shifting of the refrigeration cycle as a whole is prevented, and the pressure $P_H$ of the refrigerant in the high-pressure side is maintained.

In the example of controlling described above, setting of a target of control (setting of a target value) is carried out regarding the pressure $P_I$ of the refrigerant flowing into the expander. However, the target value may be set based on a pressure or temperature of refrigerant that is related to the pressure $P_I$ of the refrigerant flowing into the expander based on a predetermined relational expression, in other words, a predetermined refrigerant pressure or refrigerant temperature of which the pressure $P_I$ can be a function set. Taking this into consideration, controlling as illustrated above can be described as a control method in which the following steps A and B are executed in that order.

Step A: An optimum pressure $P_{IT}$ of the refrigerant flowing into the expander, or an optimum value $R_{IT}$ of a predetermined pressure or temperature that is related to the foregoing pressure, is calculated.

Step B: Which of the two of the optimum pressure $P_{IT}$ and an actual pressure $P_I$ of the refrigerant flowing into the expander is the greater, either from the optimum pressure $P_{IT}$ and the actual pressure $P_I$ or from the optimum value $R_{IT}$ and an actual value $R_I$ of the pressure or temperature corresponding to the optimum value $R_{IT}$, and if the actual pressure $P_I$ is greater than the optimum value $P_{IT}$, the control (a) is executed, while if the optimum pressure $P_{IT}$ is greater than the actual pressure $P_I$, the control (b) is executed.

This controlling may preferably be a loop control in which the process returns to step A after executing step B. In step B, neither the control (a) nor the control (b) needs to be performed if the actual pressure $P_I$ and the optimum pressure $P_{IT}$ match, but after either one is performed, the process may return to step A.

The method of calculating optimum values $P_{IT}$ and $R_{IT}$ in step A is not particularly limited. For example, it may be carried out based on the temperature of the refrigerant in the evaporator.

Figure 9:
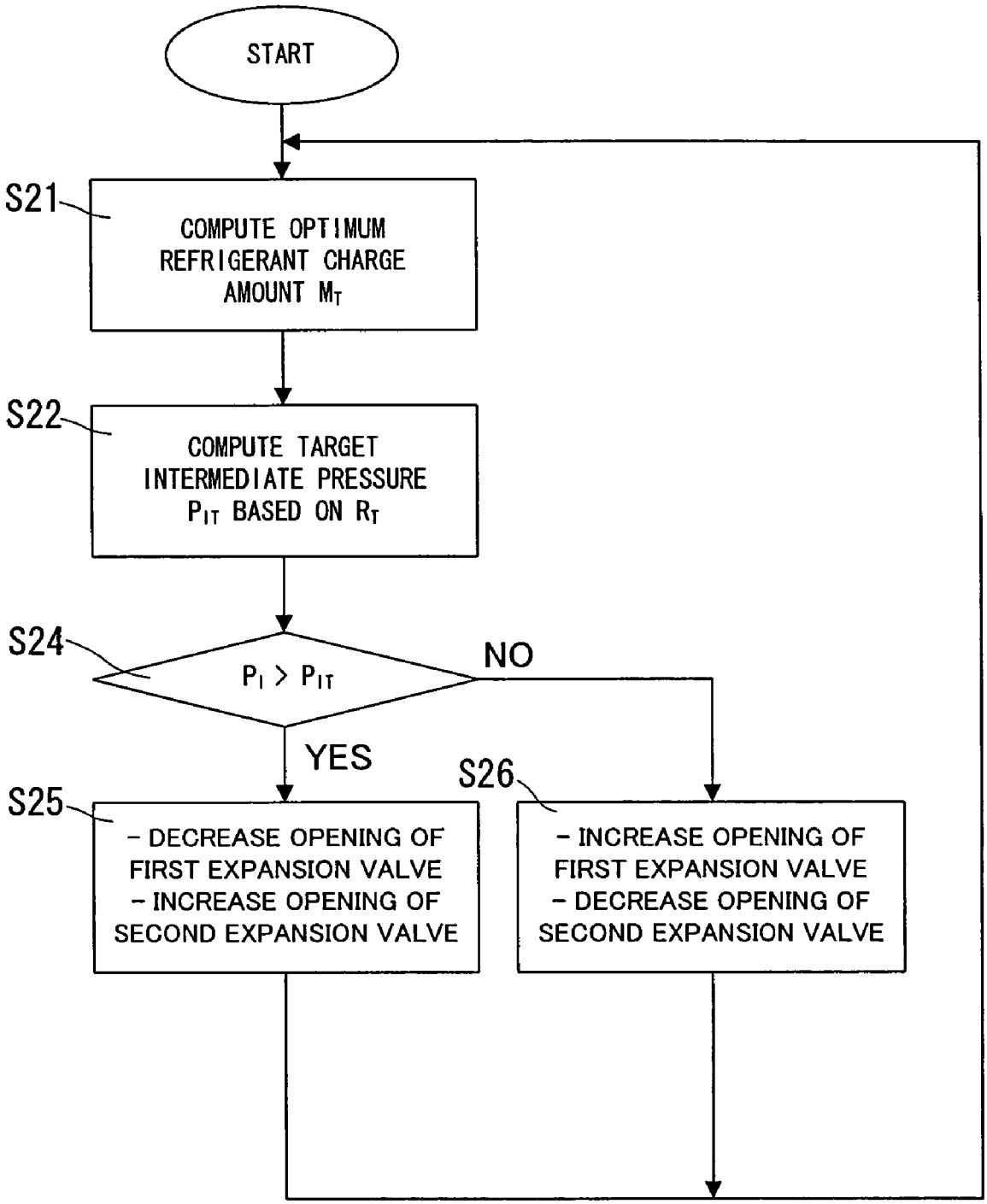
FIG. 9 is a flowchart illustrating another example of controlling the opening of the expansion valve by the control device.

FIG. 9 illustrates an example of controlling in which step 23 is eliminated from the example of controlling shown in FIG. 3. In this example of controlling, the optimization of refrigeration cycle as explained with reference to FIGS. 2, 7 and 8 is possible by repeating steps 21, 22, 24, and 25 (26).

Figure 10:
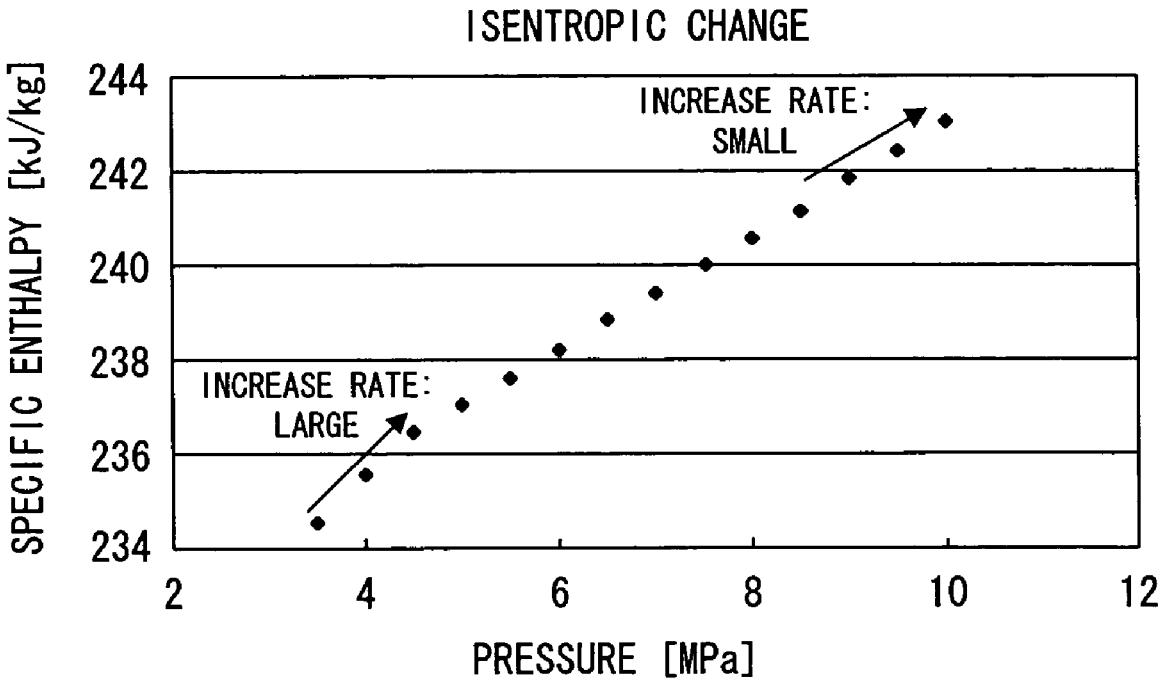
FIG. 10 is a graph illustrating the relationship between pressure and specific enthalpy when carbon dioxide as a refrigerant is caused to undergo isentropic expansion.

It is desirable that the ratio of the amount of the pressure reduction ($P_H$–$P_I$) by the first expansion valve 3 and the amount of the pressure reduction ($P_O$–$P_L$) by the second expansion valve 5 in the refrigeration cycle be adjusted as appropriate according to various conditions including the type of refrigerant. FIG. 10 is a graph illustrating, as an example, the relationship between pressure and specific enthalpy when carbon dioxide undergoes isentropic change. As shown in FIG. 10, the rate of increase in the specific enthalpy with respect to the change in pressure is relatively larger in the low-pressure side than in the high-pressure side. This means that it is more advantageous from the viewpoint of mechanical power recovery that the pressure $P_I$ of the refrigerant flowing into the expander 4 is lower.

Specifically, it is preferable that, when the refrigerant is carbon dioxide, the controller 9 control the opening of the first expansion valve 3 and the opening of the second expansion valve 5 so that the amount of the pressure reduction (pressure difference $P_1$: $P_H$–$P_I$) in the first expansion valve 3 becomes 10 to 50 and the pressure reduction amount in the second expansion valve 5 (pressure difference $P_2$: $P_O$–$P_L$) becomes 5 to 20, where the difference between the high pressure $P_H$ and the low pressure $P_L$ in the refrigeration cycle (pressure difference) is taken as 100.

Although it is not particularly limited so, the amount of the pressure reduction (pressure difference $P_3$: $P_I$–$P_O$) in the expander should preferably be from 30 to 85 (where $P_1$+$P_2$+$P_3$=100). If the pressure difference $P_3$ is too small, the amount of energy that can recovered will be small. On the other hand, if the pressure difference $P_3$ is too large, the heat pump in which energy is recovered using a power generator, for example, may result in a reduced power generation efficiency in the power generator that converts the mechanical power recovered from the expander into electric power, causing the mechanical power required by the compressor to increase significantly.

Since the heat pump 11 can adjust the amount of the refrigerant held in the expander 4 over a wide range, it is possible to ensure the reliability of the apparatus even if a receiver for refrigerant is not provided between the radiator 2 and the expander 4, or between the expander 4 and the evaporator 6. Even if a receiver is installed, the size of the receiver may be smaller than is required by conventional heat pumps. The elimination or size reduction of this member enables a size reduction of the heat pump and a reduction in the refrigerant amount to be charged in the heat pump.

Figure 11:
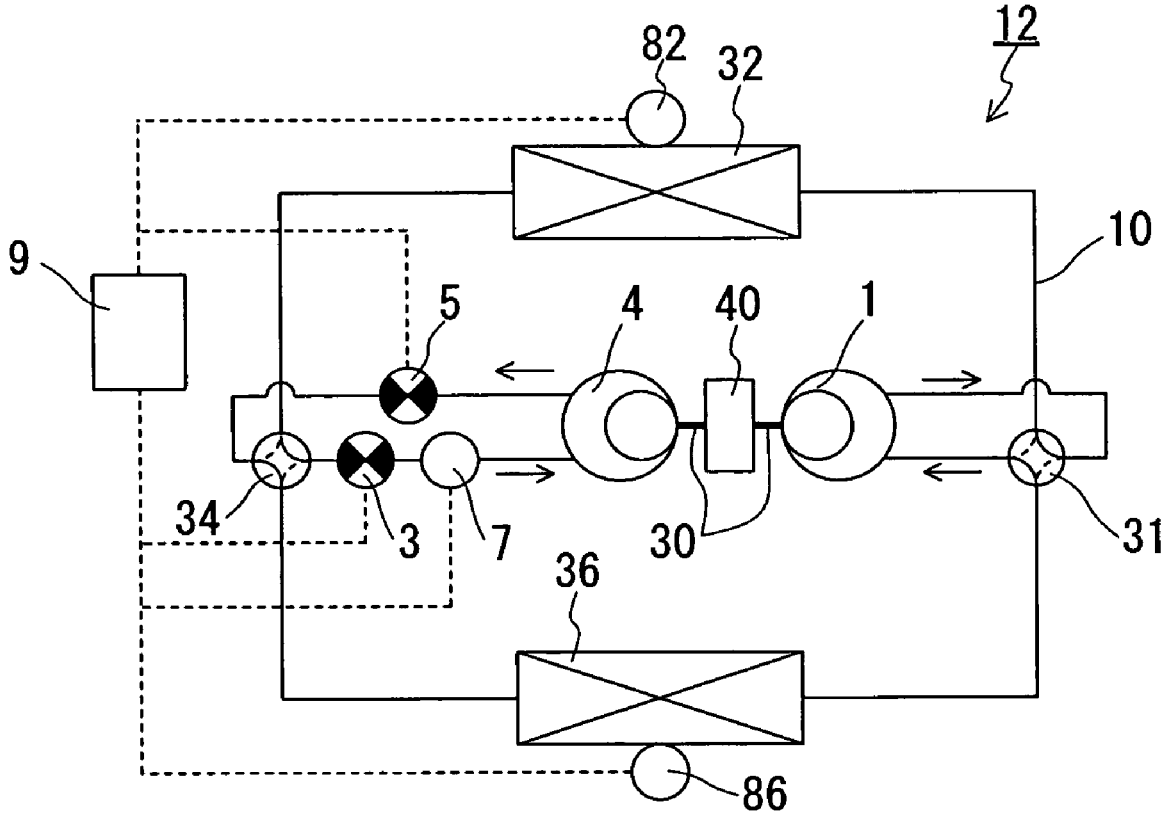
FIG. 11 illustrates another example of the configuration of the heat pump according to the present invention.

The present invention is applicable to a heat pump in which the expander and the compressor are directly coupled. FIG. 11 illustrates a heat pump of this type as an example.

In a heat pump 12 shown in FIG. 11, an expander 4 and a compressor 1 share a rotating shaft 30 and are directly coupled. A motor 40 connected to an external power supply, which is not shown, is connected to the rotating shaft 30. The compressor 1 is driven by mechanical power recovered by the expander 4, as well as mechanical power supplied by the motor 40. The heat pump of this type shows superior efficiency in energy recovery to the heat pump that performs energy conversion using a power generator because the mechanical power recovered by the expander 4 is input into the compressor 1 via the rotating shaft 30. In the heat pump of this type, however, the number of revolutions of the expander 4 and the number of revolutions of the compressor 1 cannot be set individually, and therefore, the ratio of the displacements of the expander 4 and the compressor 1 cannot be changed appropriately according to operation conditions. For this reason, the heat pump of this type has a greater necessity to control the refrigerant amount appropriately than the heat pump in which the expander 4 and the compressor 1 are not directly coupled, in order to perform smooth operations according to the conditions.

In the heat pump 12 shown in FIG. 11, the refrigerant flows through the passages in a first four-way valve 31 and a second four-way valve 34 that are indicated by solid lines during heating. In this case, the refrigerant circulates through the compressor 1, the first four-way valve 31, a first heat exchanger (indoor heat exchanger) 32 functioning as the radiator, the second four-way valve 34, a first expansion valve 3, a pressure sensor 7, the expander 4, a second expansion valve 5, the second four-way valve 34, a second heat exchanger (outdoor heat exchanger) 36 functioning as the evaporator, the first four-way valve 31, and the compressor 1, in that order. During cooling, the passages in the two four-way valves 31 and 34 are switched over, and the refrigerant flows through the passages indicated by broken lines. In this case, the refrigerant circulates through the compressor 1, the first four-way valve 31, the outdoor heat exchanger 36 functioning as the radiator, the second four-way valve 34, the first expansion valve 3, the pressure sensor 7, the expander 4, the second expansion valve 5, the second four-way valve 34, the indoor heat exchanger 32 functioning as the evaporator, the first four-way valve 31, and the compressor 1, in that order.

Thus, in the heat pump 12 further provided with the first four-way valve 31 and the second four-way valve 34 connected to the piping 10, the refrigerant circulates in a first refrigerant circuit or in a second refrigerant circuit due to switching in the first four-way valve 31 and the second four-way valve 34. The first refrigerant circuit is a passage in which the refrigerant circulates through the compressor 1, the first heat exchanger (indoor heat exchanger) 32 functioning as the radiator, the first expansion valve 3, the expander 4, the second expansion valve 5, and the second heat exchanger (outdoor heat exchanger) 36 functioning as the evaporator, in that order. The second refrigerant circuit is a passage in which the refrigerant circulates through the compressor 1, the second heat exchanger (outdoor heat exchanger) 36 functioning as the radiator, the first expansion valve 3, the expander 4, the second expansion valve 5, and the first heat exchanger (indoor heat exchanger) 32 functioning as the evaporator, in that order.

The refrigeration cycle in the heat pump 12 is the same as that of FIG. 2. The openings of the first expansion valve 3 and the second expansion valve 5 in the heat pump 12 may also be controlled, for example, in the same manner as described above with reference to FIG. 3. In the heat pump 12, respective temperature sensors 82 and 86 are provided for the two heat exchangers 32 and 36 to measure the atmospheric temperature of the heat exchanger 32 (36) that functions as the evaporator, so that the example of controlling shown in FIG. 3 can be carried out in the same way.

Figure 12:
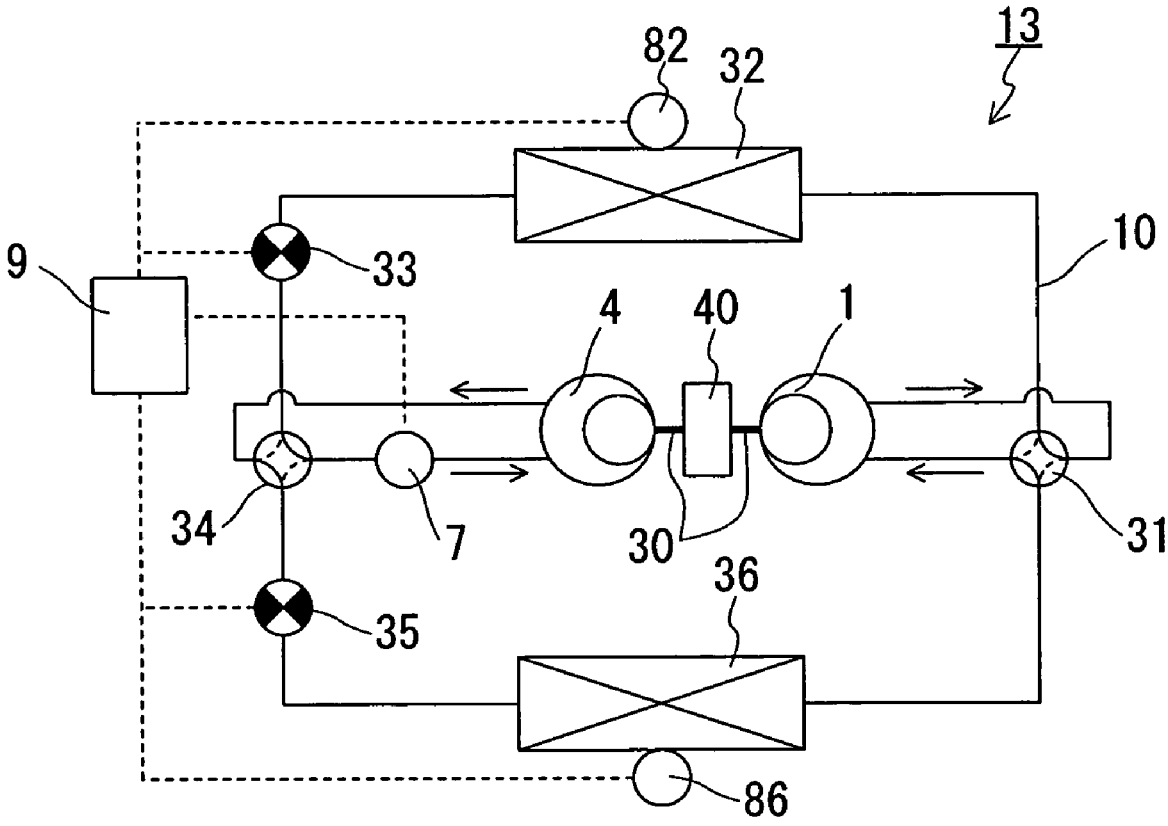
FIG. 12 illustrates still another example of the configuration of the heat pump according to the present invention.

A heat pump 13 shown in FIG. 12 has the same configuration as that of the heat pump 12 shown in FIG. 11, except for the positions of the two expansion valves. In the heat pump 12, the first expansion valve 3 is disposed between the second four-way valve 34 and the expander 4, and the second expansion valve 5 is disposed between the expander 4 and the second four-way valve 34. On the other hand, in the heat pump 13, a first expansion valve 33 is disposed between the first heat exchanger 32 and the second four-way valve 34, and a second expansion valve 35 is disposed between the second four-way valve 34 and the second heat exchanger 36.

The heat pump 13 shown in FIG. 12 further includes the first four-way valve 31 and the second four-way valve 34 connected to the piping 10, and the refrigerant circulates in a first refrigerant circuit or in a second refrigerant circuit due to switching in the first four-way valve 31 and the second four-way valve 34. The first refrigerant circuit is a passage in which the refrigerant circulates through the compressor 1, the first heat exchanger (indoor heat exchanger) 32 functioning as the radiator, the first expansion valve 33, the expander 4, the second expansion valve 35, and the second heat exchanger (outdoor heat exchanger) 36 functioning as the evaporator, in that order. The second refrigerant circuit is a passage in which the refrigerant circulates through the compressor 1, the second heat exchanger (outdoor heat exchanger) 36 functioning as the radiator, the second expansion valve 35, the expander 4, the first expansion valve 33, and the first heat exchanger (indoor heat exchanger) 32 functioning as the evaporator, in that order.

The refrigeration cycle in the heat pump 13 also is the same as that of FIG. 2. However, unlike the heat pump 12 shown in FIG. 11, when the first refrigerant circuit is selected in the heat pump 13, the expansion process for the refrigerant is carried out first at the first expansion valve 33, then at the expander 4, and then at the second expansion valve 35, but when the second refrigerant circuit is selected, the expansion process for the refrigerant is carried out first at the second expansion valve 35, then at the expander 4, and then at the first expansion valve 33. For this reason, in the heat pump 13, the controller 9 executes a control operation by changing over the control of the opening applied to the first expansion valve 3 and the control of the opening applied to the second expansion valve 5 in the case that the refrigerant circulates in the first refrigerant circuit and in the case that the refrigerant circulates in the second refrigerant circuit.

As described above, the control of the openings of the first expansion valve 3 (33) and the second expansion valve 5 (35) makes it possible to control the pressure of the refrigerant flowing into the expander (intermediate pressure) $P_I$ to be a desired value while maintaining the pressure $P_H$ in the high-pressure side of the refrigeration cycle to be a desired value. By appropriately adjusting the openings of the first expansion valve 3 (33) and the second expansion valve 5 (35), it also is possible to control the intermediate pressure $P_I$ to be a desired value while changing the pressure $P_H$ to a desired value. For example, if both the opening of the first expansion valve 3 (33) and the opening of the second expansion valve 5 (35) are increased, the refrigeration cycle shifts so that the pressure $P_H$ in the high-pressure side of the refrigeration cycle decreases; conversely, if both are decreased, the refrigeration cycle shifts so that the pressure $P_H$ in the high-pressure side rises.

In order to control the intermediate pressure $P_I$ and the pressure $P_H$ in the high-pressure side individually, it is usually sufficient to adjust the opening of the first expansion valve 3 (33) and the opening of the second expansion valve 5 (35) individually. However, in order to carry out this control more easily, or in order to carry out another control at the same time, another expansion passage may be provided in parallel with the expansion passage running through the first expansion valve 3 (33), the expander 4, and the second expansion valve 5 (35). A heat pump of this type is shown in FIG. 13 as an example.

Figure 13:
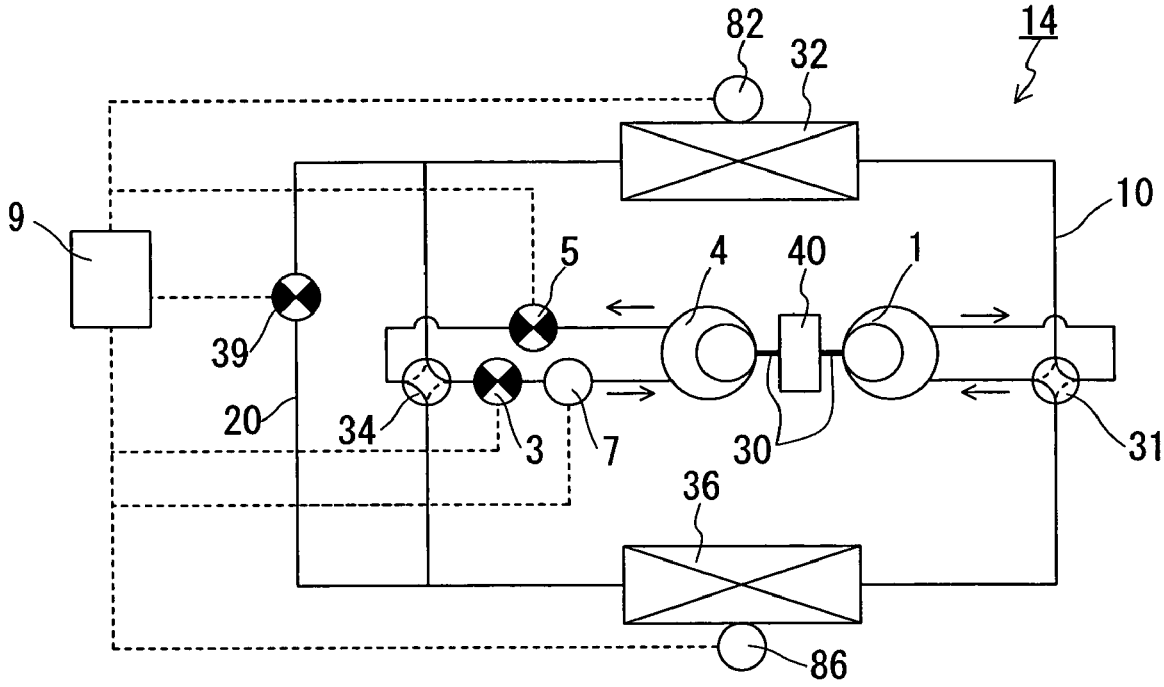
FIG. 13 illustrates yet another example of the configuration of the heat pump according to the present invention.

A heat pump 14 shown in FIG. 13 has the same configuration as that of the heat pump 12 shown in FIG. 11 except that it has bypass pipe 20 for the refrigerant, and a third expansion valve 39 disposed in the bypass pipe 20. The third expansion valve 39 has a variable opening, and is connected to the controller 9 for adjusting the opening, similar to the first and second expansion valves 3 and 5.

Specifically, in the heat pump 14, the piping 10 forms a bypass passage 20 connecting the radiator 32 (36) and the evaporator 36 (32) in parallel with the passage running through the first expansion valve 3, the expander 4, and the second expansion valve 5; the third expansion valve 39 having a variable opening is disposed in the bypass passage 20; and the controller 9 further controls the opening of the third expansion valve 39.

The control of the opening of the third expansion valve 39 by the controller 9 may be adjusted based on the temperatures measured by the temperature sensors 82 and 86 provided for the first and second heat exchangers 32 and 36, and additionally the pressure measured by the pressure sensor 7, if necessary. Alternatively, it may be adjusted based on a pressure sensor and or a temperature sensor provided separately from these sensors 7, 82, and 86. The following description explains an example in which, as illustrated in FIG. 14, the opening of the third expansion valve 39 is adjusted referring to a measured value by a temperature sensor 81 disposed adjacent to the compressor 1.

Figure 14:
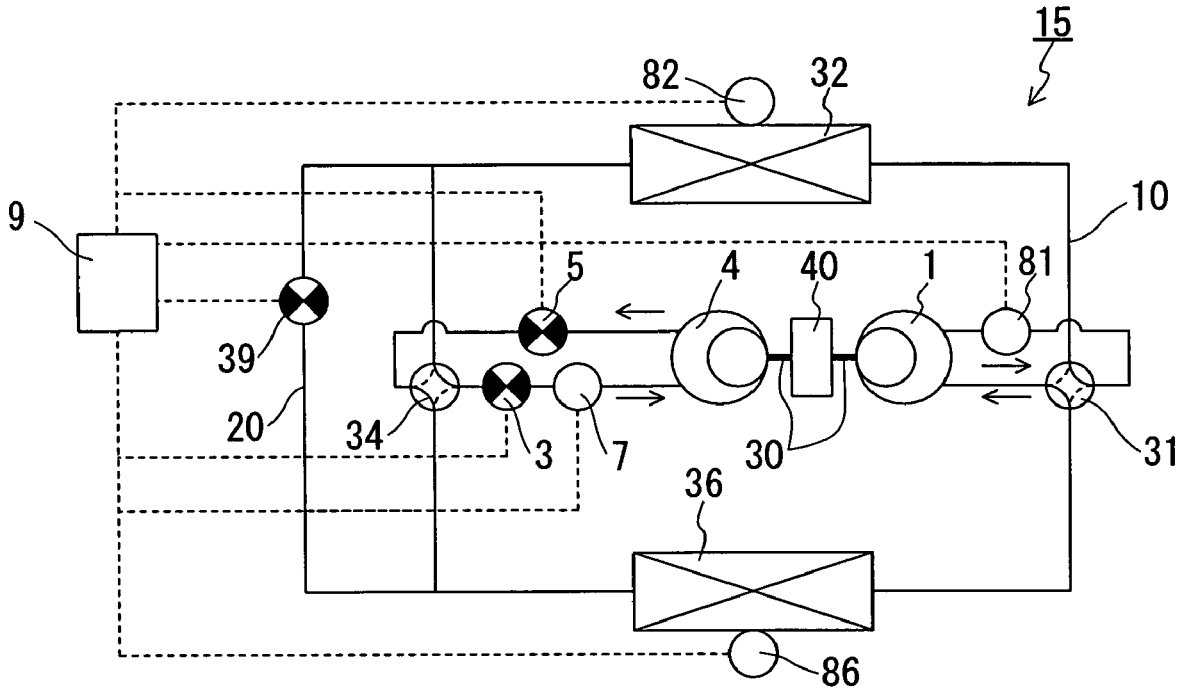
FIG. 14 illustrates further another example of the configuration of the heat pump according to the present invention.

A heat pump 15 shown in FIG. 14 has the same configuration as that of the heat pump 14 shown in FIG. 13, except that the temperature sensor 81 is installed for measuring the temperature of the refrigerant discharged from the compressor 1. The temperature sensor 81 is connected to the controller 9, like the other temperature sensors 82 and 86.

Figure 15:
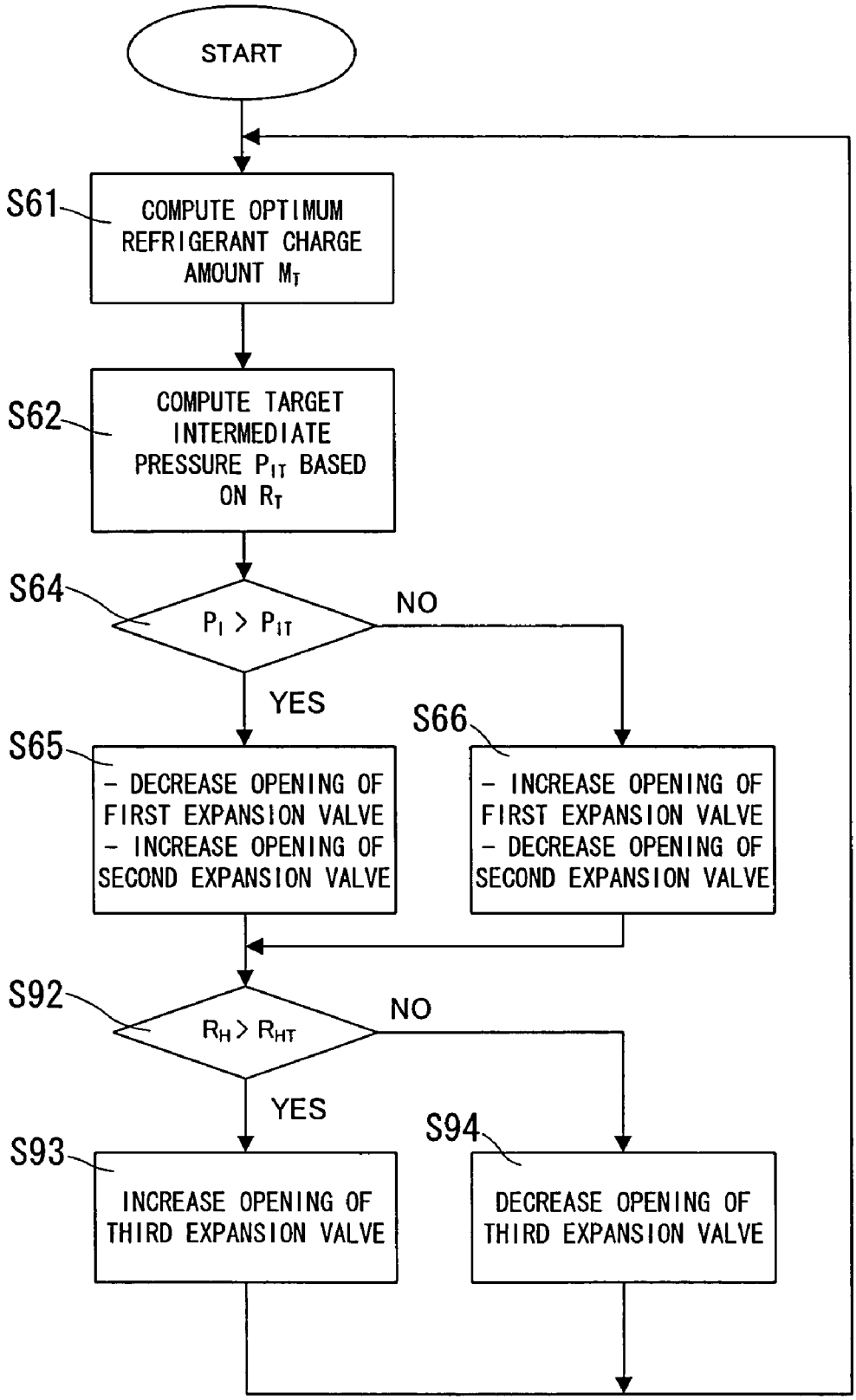
FIG. 15 is a flowchart illustrating still another example of the control of the opening of the expansion valve by the control device.

FIG. 15 illustrates, as an example, a control method of the first expansion valve 3, the second expansion valve 5, and the third expansion valve 39 by the controller 9 in the heat pump 15 shown in FIG. 14. In this example of controlling, after the pressure of the refrigerant flowing into the expander (intermediate pressure) $P_I$ has been controlled to be a desirable predetermined value that is determined according to operation conditions (steps 61 to 66), the opening of the third expansion valve 39 is controlled.

In the example of controlling shown in FIG. 15, step 61 (S61), step 62 (S62), step 64 (S64), step 65 (S65), and step 66 (S66) may be carried out in the same manner as step 21, step 22, step 24, step 25, and step 26 that are shown in FIG. 3. In this example of controlling, however, unlike the example of controlling shown in FIG. 3 the process does not return to step 61 even after step 65 or step 66 is completed, but the process moves to an additional group of steps (steps 92 to 94).

In the additional group of steps, first, the controller 9 compares a target value (target temperature) $R_{HT}$ of the temperature of the refrigerant discharged from the compressor 1, for example, 100° C., with an actual value $R_H$ measured by the temperature sensor 81 (step 92: S92). In the application as a hot water heater, the temperature "100° C.," or a slightly lower temperature, typically is required for the refrigerant discharged from the compressor.

If the measured temperature $R_H$ is higher than the target temperature $R_{HT}$, the opening of the third expansion valve 39 is increased (step 93: S93). On the other hand, if the measured temperature $R_H$ is equal to or lower than the target temperature $R_{HT}$, the opening of the third expansion valve 39 is decreased (step 94: S94). After step 93 or step 94 has been executed, the process returns to step 61.

Figure 16:
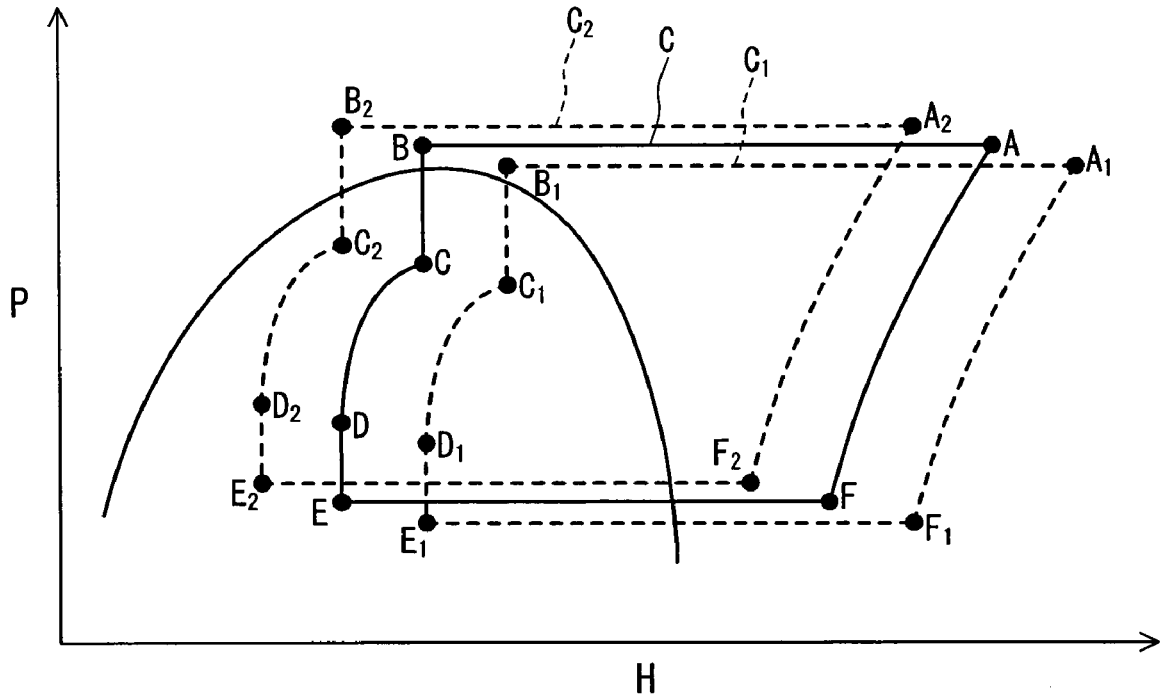
FIG. 16 is a Mollier diagram for illustrating one example of change in the refrigeration cycle through steps 92 to 94 in the control process shown in FIG. 15.

FIG. 16 shows refrigeration cycles C1 and C2, which have been shifted from the original refrigeration cycle C by the adjustment of opening in step 93 or 94. When the opening of the third expansion valve 39 is increased (step 93), the proportion of the refrigerant that expands in the expander 4 decreases relatively. Therefore, the cycle C shifts toward the cycle C1 so that the specific volume of the refrigerant increases to maintain the balance as a whole. In this case, the temperature of the refrigerant discharged from the compressor 1 lowers.

On the other hand, when the opening of the third expansion valve 39 is decreased (step 94), the cycle C shifts to the cycle $C_2$. In this case, the temperature of the refrigerant discharged from the compressor 1 rises.

Thus, the controller 9 may execute the previously described steps A and B in that order, and may further execute the following step R.

Step R: If the actual temperature $R_H$ of the refrigerant discharged from the compressor 1 is greater than the target temperature $R_{HT}$ of that refrigerant, control (c) of increasing the opening of the third throttling valve 39 is executed, and if the target temperature $R_{HT}$ is greater than the actual temperature $R_H$, control (d) of decreasing the opening of the third throttling valve 39 is executed.

This controlling preferably may be, but is not limited to, a loop control in which the process returns to step A after executing step R, and also may be such controlling in which only step R is repeated a predetermined number of times. In step R, neither the control (c) nor the control (d) needs to be performed if the actual temperature $R_H$ and the optimum temperature $R_{HT}$ match, but it is possible to perform either one of them.

In FIG. 15, the target value (target temperature) $R_{HT}$ is assumed to be a predetermined value or input value of a desirable temperature of the refrigerant discharged from the compressor. The value $R_{HT}$, which should be the target of the control, may be determined from operation conditions.

Figure 17:
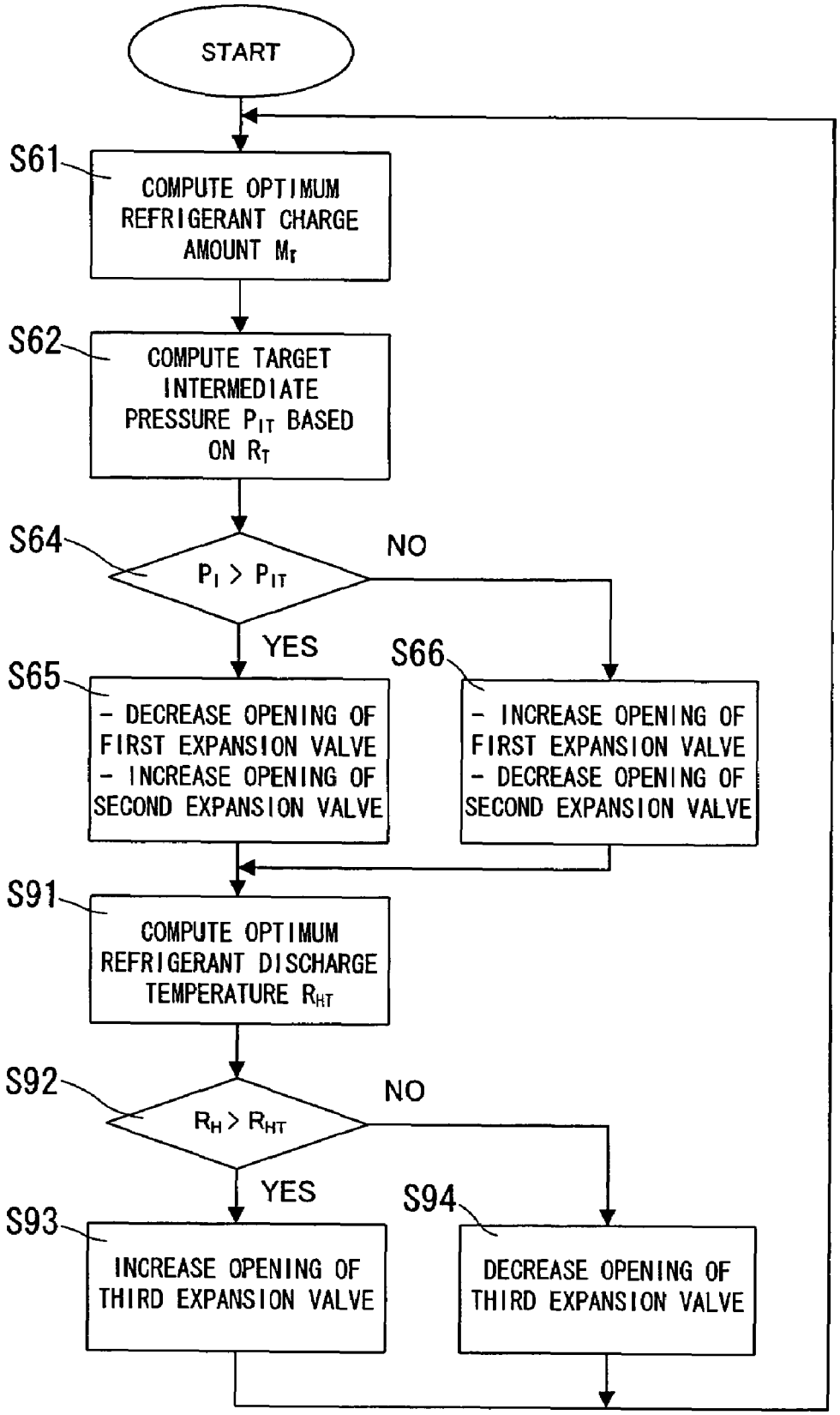
FIG. 17 is a flowchart illustrating yet another example of controlling the opening of the expansion valve by the control device.

FIG. 17 illustrates an example of controlling that includes step 91 (S91) in which an optimum value $R_{HT}$ is determined. The calculation of the optimum value $R_{HT}$ in step 91 may be carried out based on outside air temperature, compressor's operation frequency, and so forth, in applications as an air-conditioner, for example.

In the example of controlling shown in FIG. 17, the optimum value $R_{HT}$ of the temperature of the refrigerant discharged from the compressor 1 is calculated (step 91), and an actual value $R_H$ of that temperature is compared with the optimum value $R_{HT}$ to determine the magnitude relationship between the actual value $R_H$ and the optimum value $R_{HT}$. In other words, which of the two of the actual value $R_H$ and the optimum value $R_{HT}$ is the greater is determined (step 92). Then, based on the magnitude relationship, the opening of the third expansion valve 39 is adjusted in the same manner as described above (steps 93 and 94).

As will be seen clearly from FIG. 16, the control of the opening of the third expansion valve 39 referring to FIGS. 15 and 17 may be interpreted as the control of the pressure $P_H$ in the high-pressure side of the refrigeration cycle. When this interpretation is employed, the temperature of the refrigerant discharged from the compressor is a characteristic $R_H$ that is related to the pressure $P_H$ in the high-pressure side of the refrigeration cycle. The example of controlling illustrated in FIG. 17 can be described as the following steps C and D.

Step C: An optimum pressure $P_{HT}$ of the refrigerant discharged from the compressor, or an optimum value $R_{HT}$ of a predetermined pressure or temperature that is related to that pressure, is calculated.

Step D: Which of the two of the optimum pressure $P_{HT}$ and the actual pressure $P_H$ of the refrigerant discharged from the compressor is the greater either from the optimum pressure $P_{HT}$ and the actual pressure $P_H$ or from the optimum value $R_{HT}$ and an actual value $R_H$ of the pressure or temperature corresponding to the optimum value $R_{HT}$, and the control (c) of increasing the opening of the third throttling valve is executed if the actual pressure $P_H$ is greater than the optimum pressure $P_{HT}$, while the control (d) of decreasing the opening of the third throttling valve is executed if the optimum pressure $P_{HT}$ is greater than the actual pressure $P_H$.

In the example shown in FIG. 17, the magnitude relationship between the actual value $R_H$ and the optimum value $R_{HT}$ is decided in order to determine the magnitude relationship between the actual pressure $P_H$ and the optimum pressure $P_{HT}$ (step 92). The above-described controlling preferably may be, but is not limited to, a loop control in which the process returns to step A after executing step D. Or the process may return to step C, or further may move to other controlling. In step D, neither the control (c) nor the control (d) needs to be performed if the actual pressure $P_H$ and the optimum pressure $P_{HT}$ match, but it is possible to perform either one of them.

Figure 18:
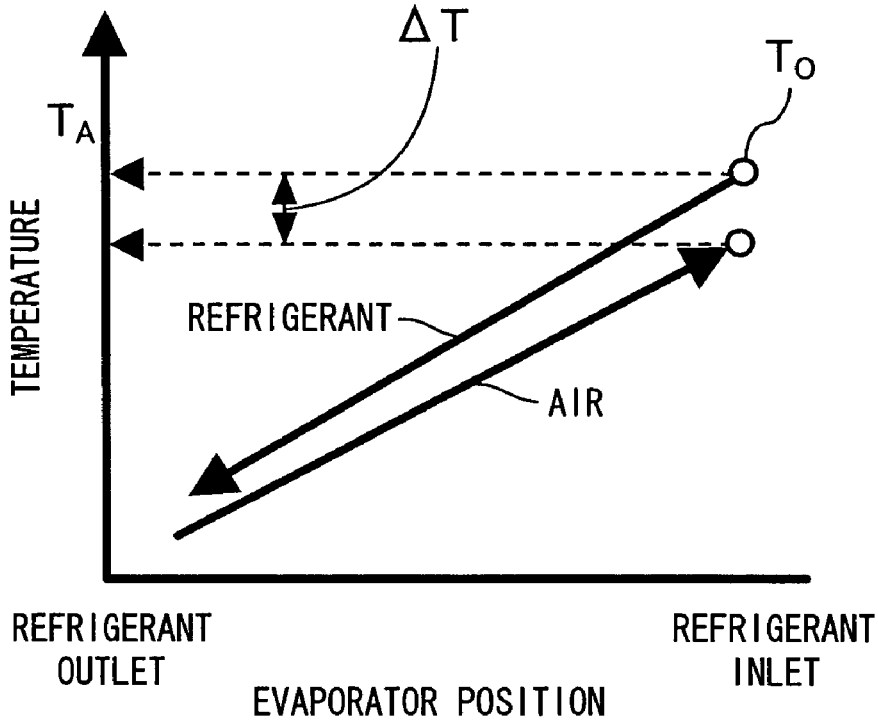
FIG. 18 is a graph illustrating one example of temperature change in refrigerant and heated medium (air) in an evaporator when using carbon dioxide as the refrigerant.
Figure 19:
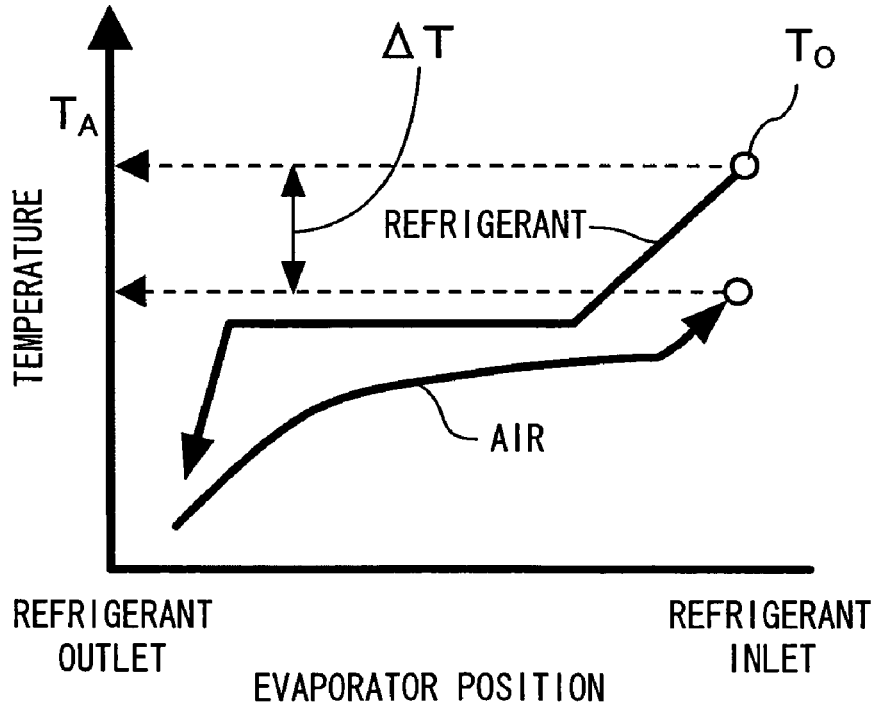
FIG. 19 is a graph illustrating one example of temperature change in refrigerant and heated medium (air) in an evaporator when using a chlorofluorocarbon as the refrigerant.

FIGS. 18 and 19 illustrate temperature changes of the refrigerant and air (heated medium) in the evaporator, in the case that carbon dioxide is used as the refrigerant and the pressure in the high-pressure side in the refrigeration cycle is set to be greater than the critical pressure of carbon dioxide (FIG. 18), and in the case that chlorofluorocarbon is used as the refrigerant (FIG. 19). In both cases, the refrigerant flows into the evaporator at a temperature $T_0$ ($T_A$), and heats up the air by heat exchange with the air. The temperature difference $\Delta T$ in the case of using carbon dioxide as the refrigerant becomes greater than the temperature difference $\Delta T$ in the case of using chlorofluorocarbon as the refrigerant. This is because, unlike chlorofluorocarbon, carbon dioxide does not undergo phase change in the evaporator. Carbon dioxide is suitable as a refrigerant for heating a heated medium to a high temperature.

The present invention has great utility value as it realizes an improvement in a heat pump useful for air-conditioners, hot water heaters, dish dryers, garbage drying disposers, and the like.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A heat pump comprising: a compressor; a radiator; a first throttling device having a variable opening; an expander; a second throttling device having a variable opening; an evaporator; piping that connects the compressor, the radiator, the first throttling device, the expander, the second throttling device, and the evaporator so that refrigerant circulates in that order; and a control device for controlling the opening of the first throttling device and the opening of the second throttling device, wherein the control device performs control (a) of decreasing the opening of the first throttling device and increasing the opening of the second throttling device, and control (b) of increasing the opening of the first throttling device and decreasing the opening of the second throttling device, wherein the control device executes, in the following order:

step A of calculating an optimum pressure $P_{IT}$ of the refrigerant flowing into the expander, or an optimum value $R_{IT}$ of a predetermined pressure or temperature that is related to the pressure of that refrigerant; and step B of determining which of the two of the optimum pressure $P_{IT}$ and an actual pressure $P_I$ of said refrigerant is the greater either from the optimum pressure $P_{IT}$ and the actual pressure $P_I$ or from the optimum value $R_{IT}$ and an actual value $R_I$ of said predetermined pressure or temperature corresponding to the optimum value $R_{IT}$, and executing the control (a) if the actual pressure $P_I$ is greater than the optimum pressure $P_{IT}$ and executing the control (b) if the optimum pressure $P_{IT}$ is greater than the actual pressure $P_I$.

2. The heat pump according to claim 1, wherein, in the step B, the control (a) or (b) is performed so that a pressure of the refrigerant discharged from the compressor becomes constant.

3. The heat pump according to claim 1, wherein, in the step A, the control device calculates the optimum pressure $P_{IT}$ or the optimum value $R_{IT}$ based on a temperature of the refrigerant in the evaporator.

4. The heat pump according to claim 1, that does not have a receiver for the refrigerant between the radiator and the expander, or between the expander and the evaporator.

5. The heat pump according to claim 1, wherein the refrigerant is carbon dioxide, and the control device controls the opening of the first throttling device and the opening of the second throttling device so that, where a pressure difference between the refrigerant at an outlet of the radiator and the refrigerant at an inlet of the evaporator is 100, a pressure difference $P_1$ in the first throttling device becomes from 10 to 50 and a pressure difference $P_2$ in the second throttling device becomes from 5 to 20.

6. The heat pump according to claim 5, wherein a pressure difference $P_3$ in the expander is from 30 to 85.

7. The heat pump according to claim 1, wherein the compressor and the expander share a rotating shaft.

8. The heat pump according to claim 1, further comprising:

a first four-way valve and a second four-way valve, connected to the piping; wherein the refrigerant circulates in a first refrigerant circuit or in a second refrigerant circuit due to switching in the first four-way valve and the second four-way valve;

the first refrigerant circuit is a passage in which the refrigerant circulates through the compressor, a first heat exchanger functioning as the radiator, the first throttling device, the expander, the second throttling device, and a second heat exchanger functioning as the evaporator, in that order; and the second refrigerant circuit is a passage in which the refrigerant circulates through the compressor, the second heat exchanger functioning as the radiator, the first throttling device, the expander, the second throttling device, and the first heat exchanger functioning as the evaporator, in that order.

9. The heat pump according to claim 1, further comprising:

a first four-way valve and a second four-way valve, connected to the piping; wherein the refrigerant circulates in a first refrigerant circuit or in a second refrigerant circuit due to switching in the first four-way valve and the second four-way valve;

the first refrigerant circuit is a passage in which the refrigerant circulates through the compressor, a first heat exchanger functioning as the radiator, the first throttling device, the expander, the second throttling device, and a second heat exchanger functioning as the evaporator, in that order;

the second refrigerant circuit is a passage in which the refrigerant circulates through the compressor, the second heat exchanger functioning as the radiator, the first throttling device, the expander, the second throttling device, and the first heat exchanger functioning as the evaporator, in that order; and the control device performs controlling by changing over the control of opening that is applied to the first throttling device and the control of opening that is applied to the second throttling device in the case that the refrigerant circulates in the first refrigerant circuit and in the case that the refrigerant circulates in the second refrigerant circuit.

10. The heat pump according to claim 1, wherein:

the piping forms a bypass passage connecting the radiator and the evaporator, in parallel with a passage running through the first throttling device, the expander, and the second throttling device;

a third throttling device having a variable opening is disposed in the bypass passage; and the controlling device also controls the opening of the third throttling device.

11. The heat pump according to claim 10, wherein:

the control device further executes step R of executing control (c) of increasing the opening of the third throttling device if an actual value $R_H$ of a temperature of the refrigerant discharged from the compressor is greater than a target value $R_{HT}$ of that temperature of the refrigerant, and executing control (d) of decreasing the opening of the third throttling device if the actual value $R_H$ is less than the target value $R_{HT}$.

12. The heat pump according to claim 11, wherein:

the control device further executes, in the following order:

step C of calculating an optimum pressure $P_{HT}$ of the refrigerant discharged from the compressor, or an optimum value $R_{HT}$ of a predetermined pressure or temperature that is related to the pressure of that refrigerant; and step D of determining which of the two of the optimum pressure $P_{HT}$ and an actual pressure $P_H$ of said refrigerant either from the optimum pressure $P_{HT}$ and the actual pressure $P_H$ of said refrigerant or from the optimum value $R_{HT}$ and an actual value $R_H$ of said predetermined pressure or temperature corresponding to the optimum value $R_{HT}$, and executing the control (c) of increasing the opening of the third throttling device if the actual pressure $P_H$ is greater than the optimum pressure $P_{HT}$ and executing the control (d) of decreasing the opening of the third throttling device if the optimum pressure $P_{HT}$ is greater than the actual pressure $P_H$.

13. The heat pump according to claim 1, wherein the displacement of the expander is set to be from 5% to 20% of the displacement of the compressor.

14. The heat pump according to claim 1, wherein:

the refrigerant is carbon dioxide; and the refrigerant is circulated so that the pressure of the refrigerant discharged from the compressor exceeds the critical pressure of carbon dioxide.

* * * * *